US010160225B2

(12) United States Patent
Koike et al.

(10) Patent No.: US 10,160,225 B2
(45) Date of Patent: Dec. 25, 2018

(54) LIQUID SUPPLYING DEVICE, LIQUID EJECTING APPARATUS, AND LIQUID SUPPLYING METHOD

(71) Applicant: SEIKO EPSON CORPORATION, Tokyo (JP)

(72) Inventors: Kaoru Koike, Matsumoto (JP); Ryoji Fujimori, Suwa (JP); Hiroki Matsuoka, Azumino (JP); Toshihiro Shinbara, Matsumoto (JP); Tsuyoshi Hayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/677,907

(22) Filed: Aug. 15, 2017

(65) Prior Publication Data

US 2018/0056664 A1 Mar. 1, 2018

(30) Foreign Application Priority Data

Aug. 30, 2016 (JP) ..... 2016-168231
May 22, 2017 (JP) ..... 2017-100658

(51) Int. Cl.
*B41J 2/175* (2006.01)
*B41J 2/165* (2006.01)
*B41J 2/18* (2006.01)

(52) U.S. Cl.
CPC ..... *B41J 2/17596* (2013.01); *B41J 2/1652* (2013.01); *B41J 2/16526* (2013.01);
(Continued)

(58) Field of Classification Search
CPC ..... B41J 2/1652; B41J 2/16526; B41J 2002/16597; B41J 2/175; B41J 2/17506;
(Continued)

(56) References Cited

U.S. PATENT DOCUMENTS 6,281,916 B1 * 8/2001 VanSteenkiste ..... B41J 2/175 347/85
7,077,513 B2 * 7/2006 Kimura ..... B41J 2/175 347/7
(Continued)

FOREIGN PATENT DOCUMENTS

JP 2000-263807 A 9/2000
JP 2001-212972 A 8/2001
(Continued)

*Primary Examiner* — Anh T. N. Vo
(74) *Attorney, Agent, or Firm* — Workman Nydegger

(57) ABSTRACT

A liquid supplying device includes a first intermediate storage and a second intermediate storage that store liquid and are provided such that the liquid can be supplied from a liquid ejecting unit which ejects the liquid, a liquid supply source holding unit that holds a liquid supply source which accommodates the liquid and that can supply the liquid accommodated in the liquid supply source to the first intermediate storage and the second intermediate storage, and a pressure regulating mechanism that can regulate pressures inside the first intermediate storage and inside the second intermediate storage. In the liquid supplying device, the inside of one intermediate storage, out of the first intermediate storage and the second intermediate storage, is depressurized, and the liquid is supplied from the liquid supply source to the one intermediate storage.

15 Claims, 10 Drawing Sheets

(52) U.S. Cl.
CPC ..... *B41J 2/175* (2013.01); *B41J 2/1752* (2013.01); *B41J 2/17506* (2013.01); *B41J 2/17509* (2013.01); *B41J 2/17523* (2013.01); *B41J 2/17556* (2013.01); *B41J 2/18* (2013.01); *B41J 2002/16597* (2013.01)

(58) Field of Classification Search
CPC .. B41J 2/17509; B41J 2/1752; B41J 2/17523; B41J 2/17556; B41J 2/17596; B41J 2/18
See application file for complete search history.

(56) References Cited

U.S. PATENT DOCUMENTS 7,261,399 B2 * 8/2007 Miki ..... B41J 2/17509 347/23
2006/0268078 A1 11/2006 Kumagai
2007/0200903 A1 * 8/2007 Takabayashi ..... B41J 2/18 347/84
2009/0201347 A1 * 8/2009 Hamano ..... B41J 2/1707 347/85
2010/0245495 A1 * 9/2010 Katada ..... B41J 2/175 347/85
2016/0089895 A1 3/2016 Iwase et al.

FOREIGN PATENT DOCUMENTS

JP 2004-025797 A 1/2004
JP 2006-272661 A 10/2006
JP 2009-226626 A 10/2009
JP 4470427 B 3/2010
JP 5460411 B 1/2014
JP 2014-162006 A 9/2014
JP 2014-188924 A 10/2014
JP 2016-022626 A 2/2016
JP 2016-068341 A 5/2016

* cited by examiner

| | ONE INTERMEDIATE STORAGE | THE OTHER INTERMEDIATE STORAGE |
|---|---|---|
| FIRST SUPPLY CONTROL | FIRST PRESSURE (DEPRESSURIZATION DEGREE: SMALL) | FIRST PRESSURE (DEPRESSURIZATION DEGREE: SMALL) |
| SECOND SUPPLY CONTROL | FIRST PRESSURE (DEPRESSURIZATION DEGREE: SMALL) | SECOND PRESSURE (DEPRESSURIZATION DEGREE: LARGE) |

LIQUID SUPPLYING DEVICE, LIQUID EJECTING APPARATUS, AND LIQUID SUPPLYING METHOD

BACKGROUND

1. Technical Field

The present invention relates to a liquid supplying device, a liquid ejecting apparatus including the liquid supplying device, and a liquid supplying method.

2. Related Art

In the related art, a recording apparatus that prints characters and images by ejecting an ink onto paper from a recording head (liquid ejecting unit) is known as an example of a liquid ejecting apparatus. Among such recording apparatuses, there is an apparatus that includes a sub-tank (intermediate storage) that stores an ink to be supplied to a recording head, a main tank (liquid supply source) that stores an ink to be supplied to the sub-tank, an ink supply path that connects the sub-tank and the main tank, and a depressurizing pump that depressurizes the inside of the sub-tank (for example, JP-A-2000-263807).

In the recording apparatus, an ink is supplied (replenishment) from the main tank to the sub-tank via the ink supply path by bringing the inside of the sub-tank into a depressurization state by means of the operation of the depressurizing pump. Next, when the supply of the ink to the sub-tank is terminated, the depressurization state of the sub-tank is released so as to be in a state where an ink can be supplied from the sub-tank to the recording head, and printing is performed by the recording head.

However, in the recording apparatus described above, an ink stored in the sub-tank cannot be supplied to the recording head since the inside of the sub-tank is depressurized while an ink is being supplied to the sub-tank. That is, in such a recording apparatus described above, the recording head cannot perform printing while an ink is being supplied to the sub-tank.

Such a problem is not limited to the recording apparatus, and is mostly common to a liquid supplying device that supplies liquid from an intermediate storage, which stores liquid supplied from a liquid supply source, to a liquid ejecting unit, a liquid ejecting apparatus including the liquid supplying device, and a liquid supplying method.

SUMMARY

An advantage of some aspects of the invention is to provide a liquid supplying device, a liquid ejecting apparatus, and a liquid supplying method that can prevent a period when liquid cannot be supplied from an intermediate storage, which stores liquid supplied from a liquid supply source, to a liquid ejecting unit from occurring.

Hereinafter, means of the invention and operation effects thereof will be described.

According to an aspect of the invention, there is provided a liquid supplying device including a first liquid flow path that can supply liquid to a liquid ejecting unit which ejects the liquid, a first intermediate storage that is provided on the first liquid flow path and stores the liquid, a second liquid flow path that can supply the liquid to the liquid ejecting unit without going through the first intermediate storage, a second intermediate storage that is provided on the second liquid flow path and stores the liquid, a liquid supply source holding unit that holds a liquid supply source accommodating the liquid and is connected to the first intermediate storage and the second intermediate storage such that the liquid accommodated in the liquid supply source can be supplied to the first intermediate storage and the second intermediate storage, a pressure regulating mechanism that can regulate pressures inside the first intermediate storage and inside the second intermediate storage, and a control unit that controls the pressure regulating mechanism such that the inside of one intermediate storage, out of the first intermediate storage and the second intermediate storage, is depressurized and the liquid is supplied from the liquid supply source to the one intermediate storage.

According to the configuration, the liquid can be supplied from the first intermediate storage to the liquid ejecting unit via the first liquid flow path, or the liquid can be supplied from the second intermediate storage to the liquid ejecting unit via the second liquid flow path. In addition, in a case where the volume of liquid stored in the first intermediate storage or the second intermediate storage is small, the liquid can be supplied from the liquid supply source to the first intermediate storage or the second intermediate storage by the pressure regulating mechanism depressurizing the inside of the first intermediate storage or the inside of the second intermediate storage.

That is, in a case where liquid is supplied to one intermediate storage by depressurizing the inside of one intermediate storage, out of the first intermediate storage and the second intermediate storage, the inside of the other intermediate storage is not depressurized. That is, in a case where liquid is supplied to one intermediate storage, the liquid can be supplied from the other intermediate storage to the liquid ejecting unit. Therefore, a period when liquid cannot be supplied from an intermediate storage, which stores liquid supplied from the liquid supply source, to the liquid ejecting unit can be prevented from occurring.

In the liquid supplying device, it is preferable that a first check valve that is provided on the first liquid flow path, allows the flow of the liquid to the liquid ejecting unit, and restricts the flow of the liquid to the first intermediate storage, a second check valve that is provided on the second liquid flow path, allows the flow of the liquid to the liquid ejecting unit, and restricts the flow of the liquid to the second intermediate storage, a third liquid flow path that is connected at a position between the first intermediate storage on the first liquid flow path and the first check valve such that the liquid accommodated in the liquid supply source may be supplied to the first intermediate storage, a third check valve that is provided on the third liquid flow path, allows the flow of the liquid to the first intermediate storage, and restricts the flow of the liquid to the liquid supply source, a fourth liquid flow path that is connected at a position between the second intermediate storage on the second liquid flow path and the second check valve such that the liquid accommodated in the liquid supply source may be supplied to the second intermediate storage, and a fourth check valve that is provided on the fourth liquid flow path, allows the flow of the liquid to the second intermediate storage, and restricts the flow of the liquid to the liquid supply source be further included.

According to the configuration, in a case where liquid is supplied from the liquid supply source to the first intermediate storage, the first check valve prevents the liquid from flowing from the liquid ejecting unit to the first intermediate storage, and the fourth check valve prevents the liquid from flowing from the second intermediate storage to the first intermediate storage. In addition, in a case where liquid is supplied from the first intermediate storage to the liquid ejecting unit, the third check valve prevents the liquid from flowing from the first intermediate storage to the liquid supply source, and the second check valve prevents the liquid from flowing from the first intermediate storage to the second intermediate storage. Except for the fact that functioning check valves are different, the same applies to a case where liquid is supplied from the liquid supply source to the second intermediate storage and a case where liquid is supplied from the second intermediate storage to the liquid ejecting unit.

Therefore, an operation of supplying liquid from the liquid supply source to one intermediate storage can be prevented from affecting the liquid ejecting unit and the other intermediate storage. In addition, an operation of supplying liquid from one intermediate storage to the liquid ejecting unit can be prevented from affecting the other intermediate storage.

In the liquid supplying device, it is preferable that a first open/closed valve that may be switched between an open state where the flow of the liquid inside the first liquid flow path is allowed and a closed state where the flow of the liquid inside the first liquid flow path is blocked and a second open/closed valve that may be switched between an open state where the flow of the liquid inside the second liquid flow path is allowed and a closed state where the flow of the liquid inside the second liquid flow path is blocked be further included, the first intermediate storage be provided such that the first intermediate storage may be separated from the first liquid flow path, and the second intermediate storage be provided such that the second intermediate storage may be separated from the second liquid flow path.

According to the configuration, the first intermediate storage and the second intermediate storage can be removed from the liquid supplying device in order to replace the first intermediate storage and the second intermediate storage. In addition, in a case where the first intermediate storage and the second intermediate storage are removed from the liquid supplying device, a liquid leak from the first liquid flow path and the second liquid flow path can be prevented by bringing the first open/closed valve and the second open/closed valve into the closed state.

In the liquid supplying device, it is preferable that the first intermediate storage and the second intermediate storage each have a liquid accommodation unit that is formed of a bag-like flexible member which may accommodate the liquid and a case in which an accommodation space accommodating the liquid accommodation unit is formed, a liquid connection port connected to a corresponding liquid flow path, out of the first liquid flow path and the second liquid flow path, be provided in the liquid accommodation unit, a pressure regulating port that may communicate with the accommodation space and the pressure regulating mechanism be provided in the case, and the pressure regulating mechanism regulate the pressures of the accommodation space.

According to the configuration, liquid can be supplied from the liquid supply source to the liquid accommodation unit by making the volume of the liquid accommodation unit larger with the depressurization of the accommodation space performed by the pressure regulating mechanism. In addition, liquid stored in the liquid accommodation unit is unlikely to come into contact with outside air, and a possibility that the liquid accommodated in the liquid accommodation unit comes into contact with outside air and deteriorates can be reduced.

In the liquid supplying device, it is preferable that a common liquid flow path that is connected to an end portion of the first liquid flow path on a liquid ejecting unit side and an end portion of the second liquid flow path on the liquid ejecting unit side such that the liquid may be supplied from the first intermediate storage and the second intermediate storage to the liquid ejecting unit and a liquid pressure regulating mechanism that is provided on the common liquid flow path and has a pressure chamber, which is a pressure chamber that may store the liquid and of which at least a part is formed of a flexible wall that may be deformed by a change in a pressure inside the pressure chamber, be further included.

According to the configuration, the liquid pressure regulating mechanism can prevent fluctuations in the pressure of liquid flowing inside the common liquid flow path and the supply of liquid to the liquid ejecting unit can be stably performed. For example, in a case where fluctuations in the pressure of liquid flowing in a liquid flow path, such as the first liquid flow path and the second liquid flow path, occur, changing the volume of the pressure chamber can prevent the downstream side of the liquid pressure regulating mechanism being affected, when supplying the liquid from the liquid supply source to the intermediate storage.

In the liquid supplying device, it is preferable that a filter unit that is provided on an upstream side of the liquid pressure regulating mechanism on the common liquid flow path and has a filter, which collects foreign substances in the liquid, and a filter chamber, which accommodates the filter, be further included.

According to the configuration, liquid including foreign substances can be prevented from being supplied to the liquid ejecting unit and the liquid pressure regulating mechanism.

In the liquid supplying device, it is preferable that the control unit control the pressure regulating mechanism such that the inside of one intermediate storage, out of the first intermediate storage and the second intermediate storage, is depressurized and the inside of the other intermediate storage is pressurized.

According to the configuration, in the midst of supplying liquid from the liquid supply source to one intermediate storage, liquid can be supplied from the other intermediate storage to the liquid ejecting unit. For this reason, the supply of liquid to the liquid ejecting unit can be continuously performed.

In the liquid supplying device, it is preferable that a pressurizing chamber that is provided on an upstream side of the liquid pressure regulating mechanism on the common liquid flow path, is a pressurizing chamber which may store the liquid, and pressurizes the liquid stored in the pressurizing chamber at a pressure lower than a pressure at which the intermediate storage is pressurized be further included.

In a case where a large amount of liquid is consumed by the liquid ejecting unit in a short period of time, the supply amount of liquid from the intermediate storage to the liquid ejecting unit does not catch up with the amount of liquid consumed by the liquid ejecting unit due to a pressure loss of a flow path ranging from the intermediate storage to the liquid ejecting unit. In this regard, since the pressurizing chamber is provided on the upstream side of the liquid pressure regulating mechanism in the configuration, liquid is supplied from the pressure chamber to the liquid ejecting unit in a case where the supply amount of liquid from the intermediate storage to the liquid ejecting unit does not catch up with the amount of liquid consumed by the liquid ejecting unit, that is, in a case where the pressure of liquid inside the pressurizing chamber declines. For this reason, liquid can be stably supplied to the liquid ejecting unit.

In the liquid supplying device, it is preferable that a first liquid flow path that may supply the liquid to the liquid ejecting unit which ejects the liquid, the first intermediate storage that is provided on the first liquid flow path and stores the liquid, the second liquid flow path that may supply the liquid to the liquid ejecting unit without going through the first intermediate storage, the second intermediate storage that is provided on the second liquid flow path and stores the liquid, the liquid supply source holding unit that holds the liquid supply source accommodating the liquid and is connected to the first intermediate storage and the second intermediate storage such that the liquid accommodated in the liquid supply source may be supplied to the first intermediate storage and the second intermediate storage, the pressure regulating mechanism that may regulate pressures inside the first intermediate storage and inside the second intermediate storage, and the control unit that controls the pressure regulating mechanism such that the operation of supplying, which is depressurizing the inside of one intermediate storage, out of the first intermediate storage and the second intermediate storage, supplying the liquid from the liquid supply source to the one intermediate storage, and supplying the liquid from the other intermediate storage to the liquid ejecting unit, is alternately repeated with respect to the first intermediate storage and the second intermediate storage be included. It is preferable that the control unit perform first supply control of controlling the pressure regulating mechanism such that the depressurization of the inside of the one intermediate storage is stopped in a case where a storage amount inside the one intermediate storage is a first set value, the inside of the other intermediate storage is depressurized in a case where a storage amount inside the other intermediate storage is a second set value that is smaller than the first set value, and the liquid is supplied from the one intermediate storage to the liquid ejecting unit, and perform second supply control of controlling the pressure regulating mechanism such that the depressurization of the inside of the one intermediate storage is stopped in a case where a storage amount inside the other intermediate storage is the second set value while the inside of the one intermediate storage is being depressurized, and the liquid is supplied from the one intermediate storage to the liquid ejecting unit.

According to the configuration, the pressure regulating mechanism depressurizes the inside of one intermediate storage, out of the first intermediate storage and the second intermediate storage, supplies liquid from the liquid supply source to one intermediate storage, and supplies liquid from the other intermediate storage to the liquid ejecting unit. When a storage amount inside the other intermediate storage is the second set value, the pressure regulating mechanism stops depressurizing the inside of one intermediate storage and supplies liquid from one intermediate storage to the liquid ejecting unit even when the inside of one intermediate storage is being depressurized. Therefore, a period when liquid cannot be supplied from an intermediate storage, which stores liquid supplied from the liquid supply source, to the liquid ejecting unit can be prevented from occurring.

According to another aspect of the invention, there is provided a liquid ejecting apparatus including a liquid ejecting unit that ejects liquid, a first liquid flow path that can supply the liquid to the liquid ejecting unit, a first intermediate storage that is provided on the first liquid flow path and stores the liquid, a second liquid flow path that can supply the liquid to the liquid ejecting unit without going through the first intermediate storage, a second intermediate storage that is provided on the second liquid flow path and stores the liquid, a liquid supply source holding unit that holds a liquid supply source accommodating the liquid and is connected to the first intermediate storage and the second intermediate storage such that the liquid accommodated in the liquid supply source can be supplied to the first intermediate storage and the second intermediate storage, a pressure regulating mechanism that can regulate pressures inside the first intermediate storage and inside the second intermediate storage, and a control unit that controls the pressure regulating mechanism such that the inside of one intermediate storage, out of the first intermediate storage and the second intermediate storage, is depressurized and the liquid is supplied from the liquid supply source to the one intermediate storage.

According to the configuration, in the liquid ejecting apparatus, the same operation effects as those of the liquid supplying device described above can be obtained.

In the liquid ejecting device, it is preferable that the liquid ejecting unit that ejects the liquid, the first liquid flow path that may supply the liquid to the liquid ejecting unit, the first intermediate storage that is provided on the first liquid flow path and stores the liquid, the second liquid flow path that may supply the liquid to the liquid ejecting unit without going through the first intermediate storage, the second intermediate storage that is provided on the second liquid flow path and stores the liquid, the liquid supply source holding unit that holds the liquid supply source accommodating the liquid and is connected to the first intermediate storage and the second intermediate storage such that the liquid accommodated in the liquid supply source may be supplied to the first intermediate storage and the second intermediate storage, the pressure regulating mechanism that may regulate pressures inside the first intermediate storage and inside the second intermediate storage, the control unit that controls the pressure regulating mechanism such that the inside of one intermediate storage, out of the first intermediate storage and the second intermediate storage, is depressurized, the liquid is supplied from the liquid supply source to the one intermediate storage, and the liquid is supplied from the other intermediate storage to the liquid ejecting unit be included. It is preferable that the control unit perform first supply control of controlling the pressure regulating mechanism such that the depressurization of the inside of the one intermediate storage is stopped in a case where a storage amount inside the one intermediate storage is a first set value, the inside of the other intermediate storage is depressurized in a case where a storage amount inside the other intermediate storage is a second set value that is smaller than the first set value, and the liquid is supplied from the one intermediate storage to the liquid ejecting unit, and perform second supply control of controlling the pressure regulating mechanism such that the depressurization of the inside of the one intermediate storage is stopped in a case where a storage amount inside the other intermediate storage is the second set value while the inside of the one intermediate storage is being depressurized, and the liquid is supplied from the one intermediate storage to the liquid ejecting unit.

According to the configuration, in the liquid ejecting apparatus, the same operation effects as those of the liquid supplying device described above can be obtained.

According to still another aspect of the invention, there is provided a liquid supplying method of a liquid supplying device including a first liquid flow path that can supply liquid to a liquid ejecting unit which ejects the liquid, a first intermediate storage that is provided on the first liquid flow path and stores the liquid, a second liquid flow path that can supply the liquid to the liquid ejecting unit without going through the first intermediate storage, and a second intermediate storage that is provided on the second liquid flow path and stores the liquid, and of alternately repeating an operation of supplying, which is depressurizing the inside of one intermediate storage, out of the first intermediate storage and the second intermediate storage, and supplying the liquid from the liquid supply source accommodating the liquid to the one intermediate storage while supplying the liquid from the other intermediate storage to the liquid ejecting unit, with respect to the first intermediate storage and the second intermediate storage. The liquid supplying method includes supplying the liquid from the one intermediate storage to the liquid ejecting unit by stopping the depressurization of the inside of the one intermediate storage in a case where a storage amount inside the one intermediate storage is a first set value and by depressurizing the inside of the other intermediate storage in a case where a storage amount inside the other intermediate storage is a second set value that is smaller than the first set value, and supplying the liquid from the one intermediate storage to the liquid ejecting unit by stopping the depressurization of the inside of the one intermediate storage in a case where a storage amount inside the other intermediate storage is the second set value while the inside of the one intermediate storage is being depressurized.

According to the configuration, in the liquid supplying method, the same operation effects as those of the liquid supplying device described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a liquid ejecting apparatus according to a first embodiment will be described with reference to the drawings. The liquid ejecting apparatus of the embodiment is an ink jet printer that prints characters and images by ejecting an ink, which is an example of liquid, onto a medium, such as paper. In addition, the liquid ejecting apparatus of the embodiment is also a large format printer that performs printing onto a long medium.

Figure 1:
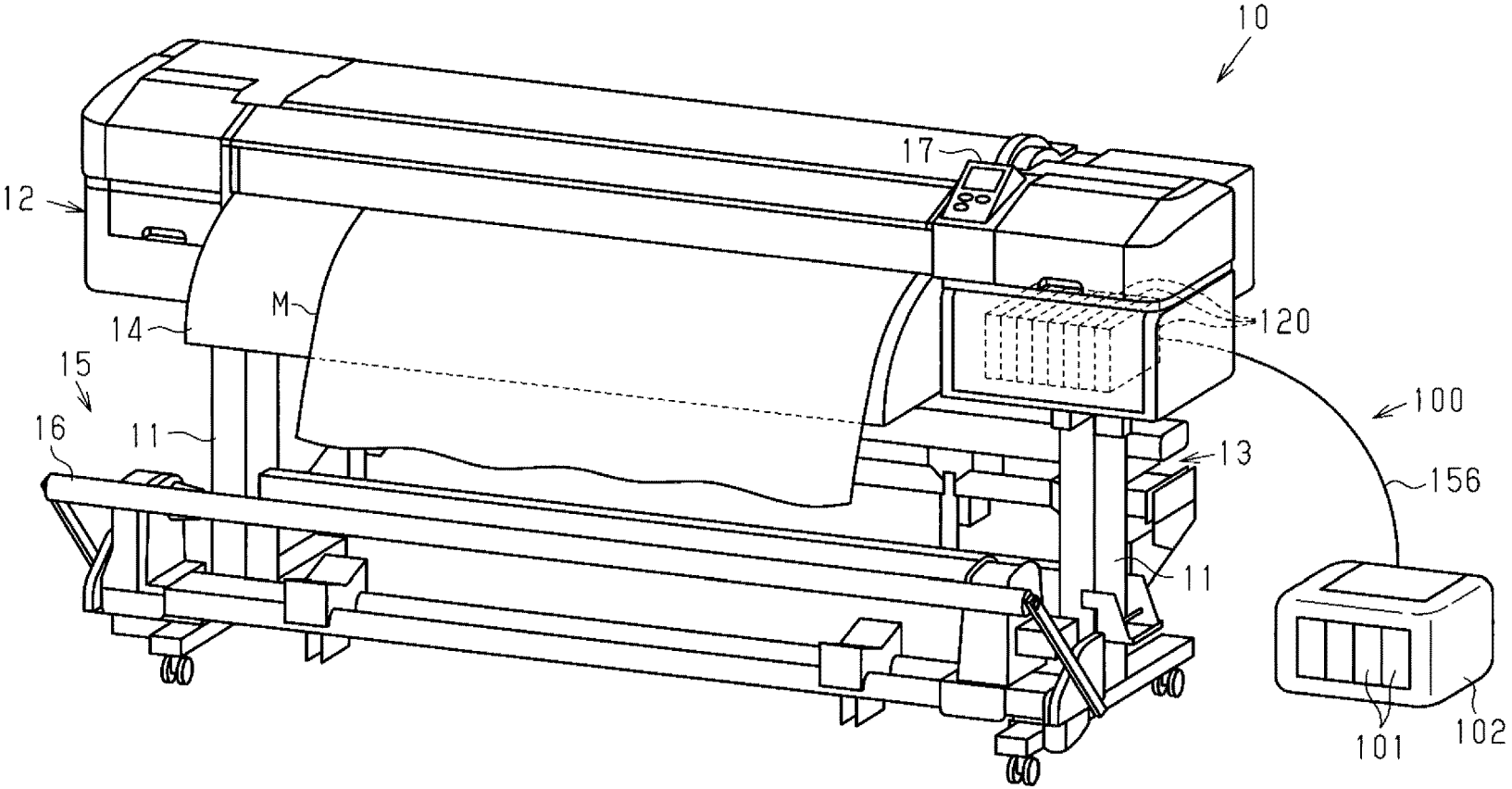
FIG. 1 is a perspective view of a liquid ejecting apparatus according to one embodiment.

As illustrated in FIG. 1, a liquid ejecting apparatus 10 includes a pair of leg portions 11, a housing 12 provided on the leg portions 11, a reeling-out unit 13 that reels out a medium M rolled up around a roll body toward the inside of the housing 12, a guiding unit 14 that guides the medium M sent out from the housing 12, and a winding unit 15 that winds the medium M guided by the guiding unit 14 around the roll body. In addition, the liquid ejecting apparatus 10 includes a tension applying mechanism 16 that applies tension to the medium M wound around the winding unit 15 and an operation panel 17 operated by a user.

In the embodiment, a longitudinal direction of the liquid ejecting apparatus 10 is a "width direction", a depth direction of the liquid ejecting apparatus 10 is a "front/rear direction", and an up/down direction of the liquid ejecting apparatus 10, which is also a longitudinal direction of the leg portions 11, is a "vertical direction". Herein, the width direction, the front/rear direction, and the vertical direction are directions orthogonal to each other.

Figure 2:
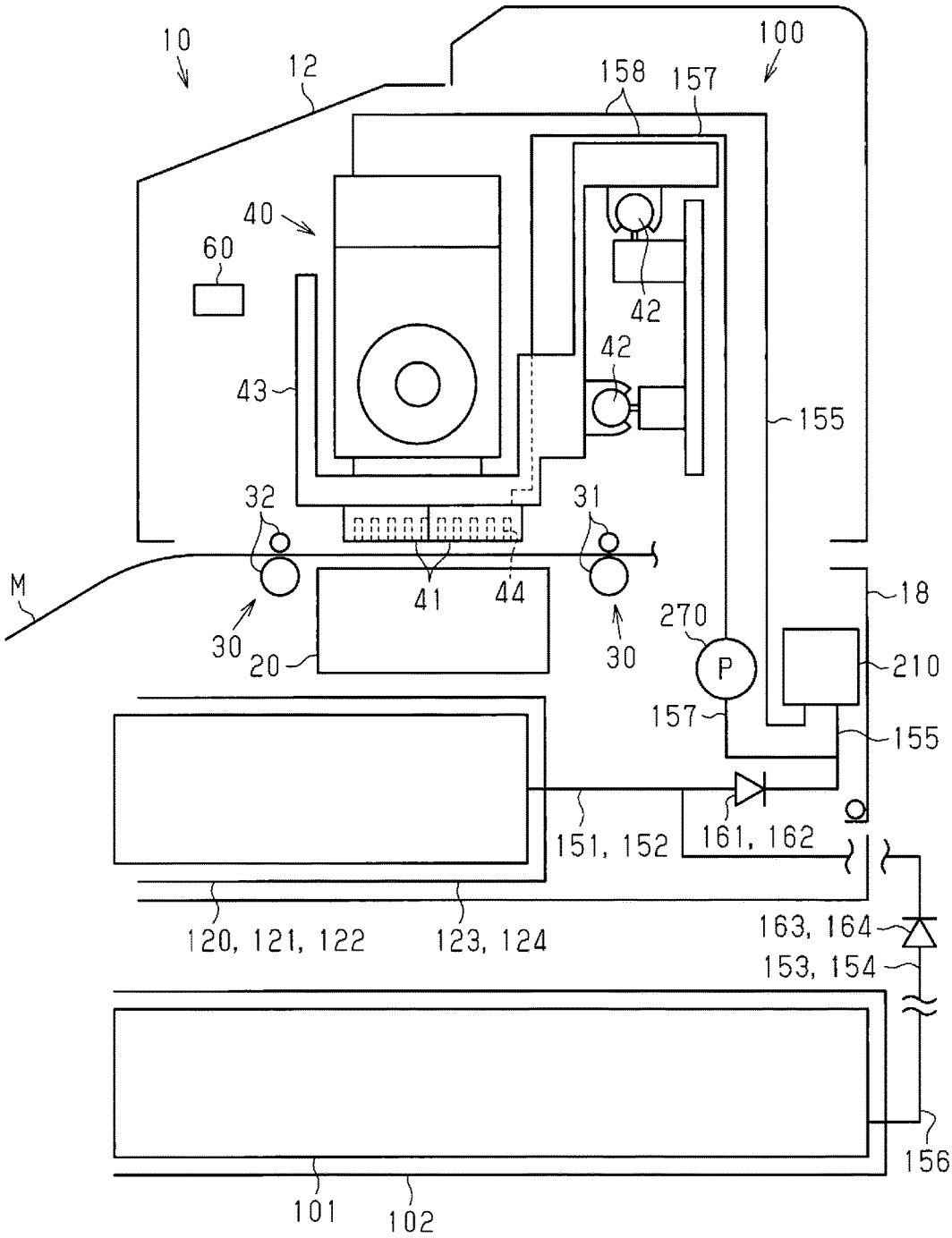
FIG. 2 is a side view illustrating a schematic configuration of the liquid ejecting apparatus.
Figure 3:
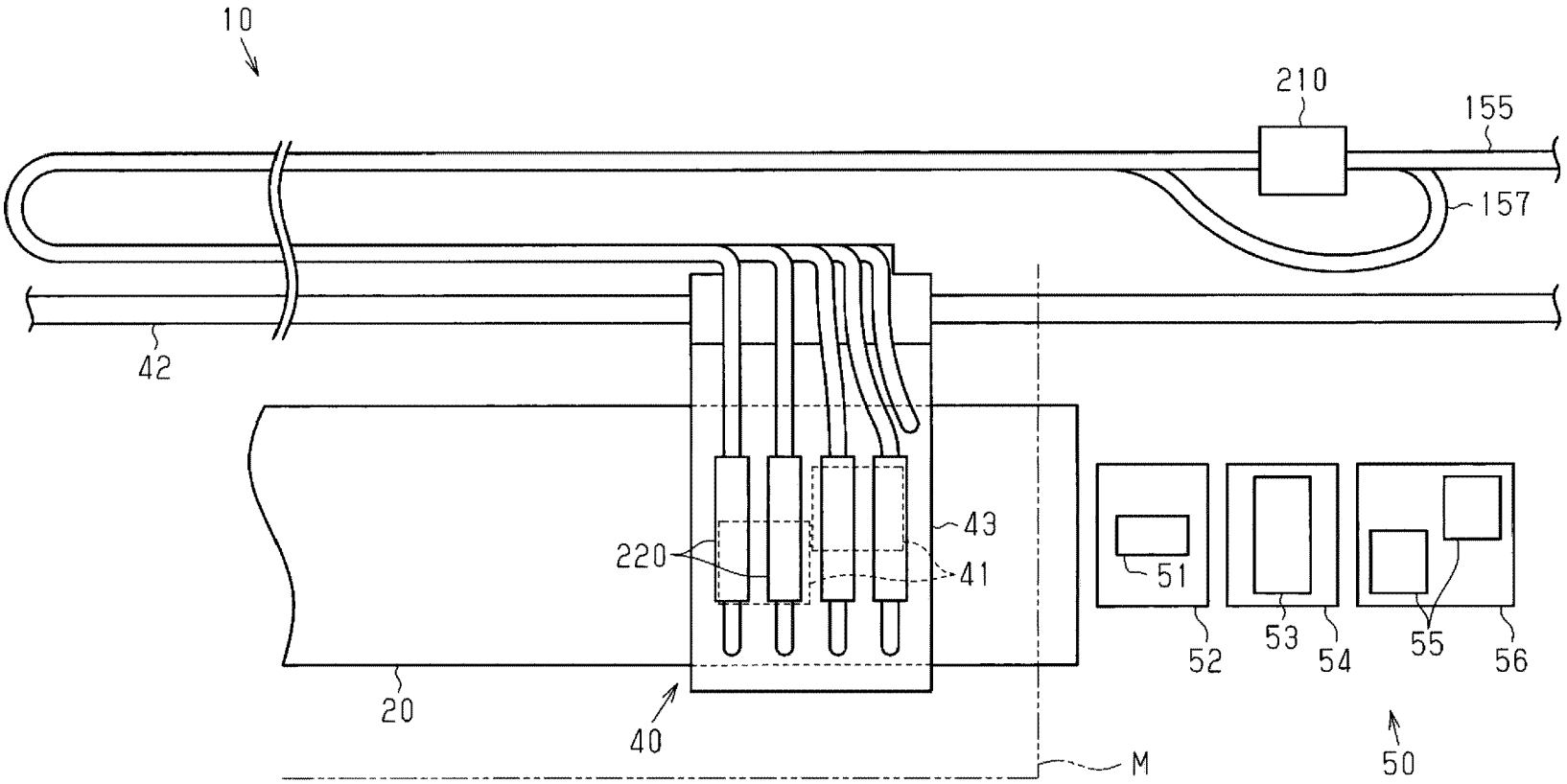
FIG. 3 is a plan view illustrating the schematic configuration of the liquid ejecting apparatus.

As illustrated in FIG. 2 and FIG. 3, the liquid ejecting apparatus 10 includes a support base 20 that supports the medium M, a transporting unit 30 that transports the medium M, a printing unit 40 that performs printing onto the medium M, a maintenance unit 50 that performs maintenance of the printing unit 40, and a control unit 60 that controls the operation of the liquid ejecting apparatus 10. In addition, as illustrated FIG. 1 and FIG. 2, the liquid ejecting apparatus 10 includes a liquid supplying device 100 that supplies liquid to the printing unit 40.

As illustrated in FIG. 2 and FIG. 3, the support base 20 extends in a width direction of the medium M, which is orthogonal to (intersects) a transporting direction of the medium M. In addition, as illustrated in FIG. 2, the transporting unit 30 includes a pair of transporting rollers 31 and 32 disposed on both sides of the support base 20 in the transporting direction. The medium M pinched by the pair of transporting rollers 31 and 32 is transported in the transporting direction along an exterior surface of the support base 20 by a transporting motor (not illustrated) driving the pair of transporting rollers 31 and 32.

The printing unit 40 includes a liquid ejecting unit 41 that ejects liquid, a guide shaft 42 that extends in the width direction, and a carriage 43 that is guided by the guide shaft 42 and is reciprocable in the width direction. The carriage 43 moves with the driving of a carriage motor (not illustrated).

Figure 4:
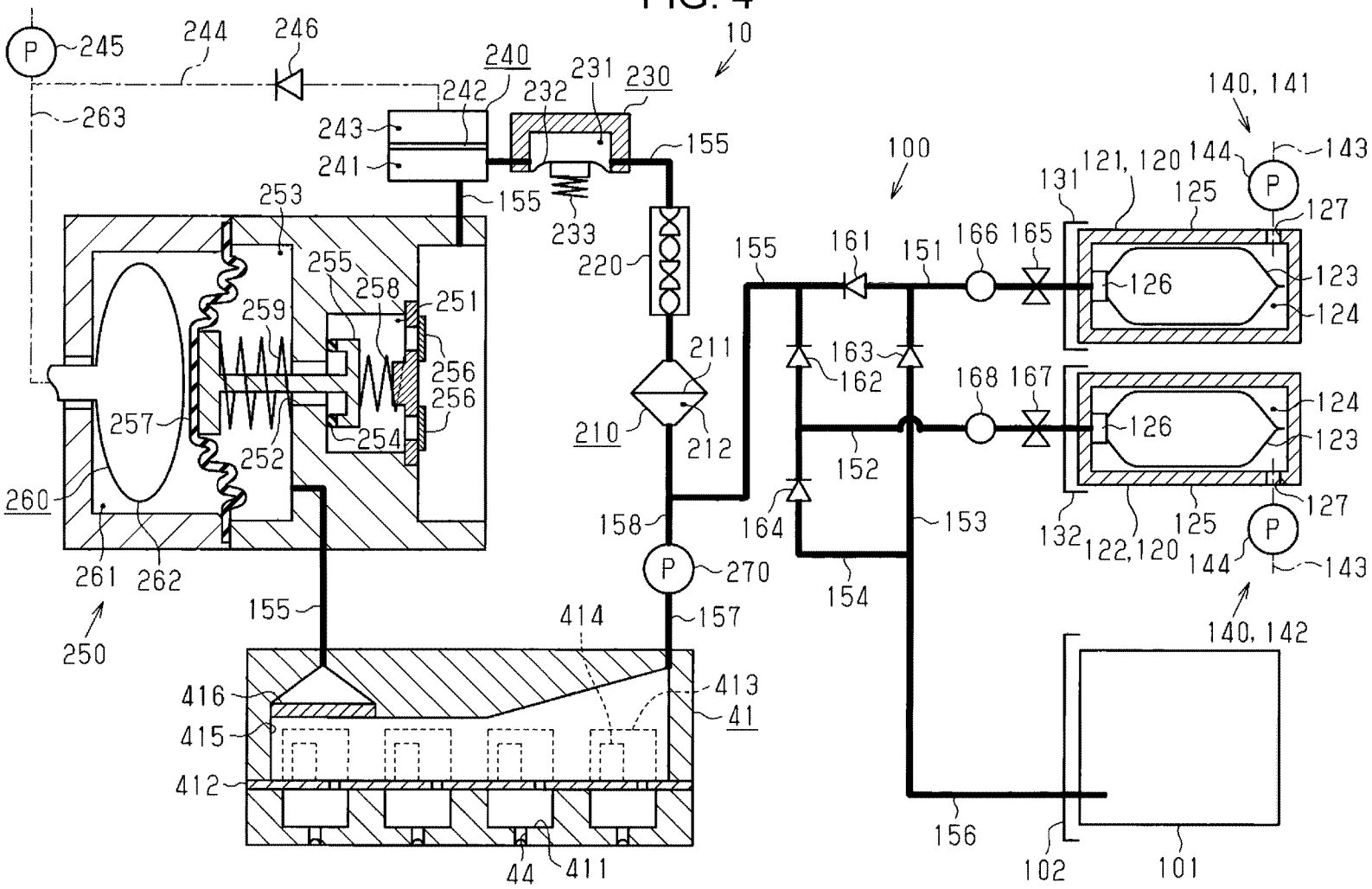
FIG. 4 is a schematic diagram illustrating a liquid supplying device included in the liquid ejecting apparatus.

As illustrated in FIG. 4, the liquid ejecting unit 41 includes individual liquid chambers 411 that communicate with nozzles 44, accommodation units 413 that are partitioned from the individual liquid chambers 411 with a diaphragm 412, and actuators 414 accommodated in the accommodation units 413. In addition, the liquid ejecting unit 41 includes a common liquid chamber 415 that stores a supplied liquid temporarily and supplies the liquid to the plurality of individual liquid chambers 411, and a filter 416 that filters liquid that flows into the common liquid chamber 415.

The actuators 414 are, for example, piezoelectric elements that contract in a case where a drive voltage is applied. When the application of the drive voltage is released after the diaphragm 412 is deformed with the contraction of the actuators 414, liquid inside the individual liquid chambers 411 of which volumes have changed are ejected as droplets from the nozzles 44.

As illustrated in FIG. 3, the maintenance unit 50 is provided in a region adjacent to the support base 20 in the width direction. The maintenance unit 50 includes a wiping mechanism 52 that has a wiping member 51 that wipes the liquid ejecting unit 41, a flushing mechanism 54 that has a liquid accommodation unit 53 that accommodates liquid to be ejected by the liquid ejecting unit 41, and a cap mechanism 56 that has caps 55 covering the nozzles 44 of the liquid ejecting unit 41. The wiping mechanism 52, the flushing mechanism 54, and the cap mechanism 56 are disposed so as to line up in a moving direction of the carriage 43.

The wiping mechanism 52 wipes the liquid ejecting unit 41 (nozzle surface) by relatively moving the wiping member 51 with respect to the liquid ejecting unit 41. When performing flushing, which is draining droplets from the nozzles 44, the flushing mechanism 54 accommodates the drained liquid in the liquid accommodation unit 53 for the purpose of preventing or eliminating the clogging of the nozzles 44. The liquid accommodation unit 53 can be configured with, for example, a rotating endless belt. In addition, the cap mechanism 56 performs capping, which is making a space where the nozzles 44 of the liquid ejecting unit 41 open a closed space. Capping is performed in order to prevent the nozzles 44 of the liquid ejecting unit 41 from becoming dry.

The cap mechanism 56 may execute suction cleaning, which is forcibly discharging liquid via the nozzles 44 of the liquid ejecting unit 41, by further including a suction pump, which sucks the inside of the caps 55, in the caps 55, and driving the suction pump in a state where capping has performed.

Next, a configuration of the liquid supplying device 100 on an upstream side will be described in detail.

In the following description, the upstream side and a downstream side are in a direction of liquid flowing in the liquid supplying device 100. In addition, the liquid supplying device 100 is provided for each type of liquid ejected from the liquid ejecting unit 41. For example, in the case of a printer, the liquid supplying device 100 is provided for each color of ink.

As illustrated in FIG. 1, the liquid supplying device 100 includes a liquid supply source holding unit 102 that holds a liquid supply source 101, which is a source for supplying liquid to the liquid ejecting unit 41. The liquid supply source 101 may have a configuration in which the liquid supply source can accommodate liquid. For example, the liquid supply source 101 may be a liquid supply source 101 which can be replaced or may be a tank type which can be refilled with liquid. In a case where the liquid supply source 101 is a cartridge type, it is preferable that the liquid supply source holding unit 102 detachably hold the liquid supply source 101. In a case where the liquid supply source 101 is a tank type, it is preferable that the liquid supply source holding unit 102 undetachably hold the liquid supply source 101.

As illustrated in FIG. 4, the liquid supplying device 100 includes a first intermediate storage 121 (120) and a second intermediate storage 122 (120), in which liquid supplied from the liquid supply source 101 is stored, on the downstream side of the liquid supply source 101. In addition, the liquid supplying device 100 includes a first intermediate storage holding unit 131 that holds the first intermediate storage 121, a second intermediate storage holding unit 132 that holds the second intermediate storage 122, and a pressure regulating mechanism 140 that regulates pressures inside the intermediate storages 120.

In addition, the liquid supplying device 100 includes a first liquid flow path 151, of which an upstream end is connected to the first intermediate storage 121, a second liquid flow path 152, of which an upstream end is connected to the second intermediate storage 122, a third liquid flow path 153, of which a downstream end is connected to the first liquid flow path 151, and a fourth liquid flow path 154, of which a downstream end is connected to the second liquid flow path 152. In addition, the liquid supplying device 100 includes a supply flow path 155 that connects the downstream ends of the first liquid flow path 151 and the second liquid flow path 152 to the liquid ejecting unit 41, and a replenishment flow path 156 that connects the upstream ends of the third liquid flow path 153 and the fourth liquid flow path 154 to the liquid supply source 101 (liquid supply source holding unit 102). In addition, the liquid supplying device 100 includes a return flow path 157 that configures a circulation flow path 158 with the supply flow path 155.

Furthermore, the liquid supplying device 100 includes a first check valve 161, a first open/closed valve 165, and a first flow rate sensor 166, which are provided on the first liquid flow path 151, and a second check valve 162, a second open/closed valve 167, and a second flow rate sensor 168, which are provided on the second liquid flow path 152. In addition, the liquid supplying device 100 includes a third check valve 163 provided on the third liquid flow path 153 and a fourth check valve 164 provided on the fourth liquid flow path 154.

As illustrated in FIG. 4, the first intermediate storage 121 and the second intermediate storage 122 are provided so as to correspond to one liquid supply source 101. That is, in the embodiment, liquid supplied from one liquid supply source 101 is stored in two intermediate storages 120. In addition, it can be said that the first intermediate storage 121 is provided on the first liquid flow path 151 and the second intermediate storage 122 is provided on the second liquid flow path 152.

In addition, the first intermediate storage 121 and the second intermediate storage 122 have liquid accommodation units 123 that are formed of bag-like flexible members that can accommodate liquid, and cases 125, in which accommodation spaces 124 accommodating the liquid accommodation units 123 are formed. Liquid connection ports 126 that allow the inside of the liquid accommodation units 123 to communicate with the first liquid flow path 151 are provided in the liquid accommodation units 123. In addition, pressure regulating ports 127 that can make the accommodation spaces 124 communicate with the pressure regulating mechanism 140 are provided in the cases 125. It is preferable that the accommodation spaces 124 of the cases 125 be closed spaces, and it is preferable that the inflow and outflow of gas do not occur except for the pressure regulating ports 127.

The upstream end of the first liquid flow path 151 is connected to the first intermediate storage holding unit 131, and the upstream end of the second liquid flow path 152 is connected to the second intermediate storage holding unit 132. The first intermediate storage holding unit 131 and the second intermediate storage holding unit 132 detachably hold the intermediate storages 120. For this reason, the first intermediate storage 121 can be separated from the first liquid flow path 151 by removing the first intermediate storage 121 from the first intermediate storage holding unit 131, and the second intermediate storage 122 can be separated from the second liquid flow path 152 by removing the second intermediate storage 122 from the second intermediate storage holding unit 132.

The pressure regulating mechanism 140 has a first pressure regulating mechanism 141 that regulates a pressure inside the first intermediate storage 121 and a second pressure regulating mechanism 142 that regulates a pressure inside the second intermediate storage 122. The first pressure regulating mechanism 141 and the second pressure regulating mechanism 142 have a pressure regulating flow path 143 connected to the pressure regulating ports 127 of the intermediate storages 120 without gaps and pressure regulating pumps 144 provided on the pressure regulating flow path 143. The pressure regulating mechanism 140 pressurizes the insides of the intermediate storages 120 by carrying gas to the accommodation spaces 124 of the cases 125 by means of the driving of the pressure regulating pumps 144, or depressurizes the insides of the intermediate storages 120 by discharging the gas from the accommodation spaces 124 of the cases 125.

In addition, out of the first intermediate storage 121 and the second intermediate storage 122, the accommodation space 124 of one intermediate storage 120 can be pressurized while the accommodation space 124 of the other intermediate storage 120 is being depressurized since the pressure regulating mechanism 140 is provided for each intermediate storage 120. In addition, in the following description, pressurizing the accommodation spaces 124 of the intermediate storages 120 will also be simply referred to as "pressurizing the insides of the intermediate storages 120", and depressurizing the accommodation spaces 124 of the intermediate storages 120 will also be simply referred to as "depressurizing the insides of the intermediate storages 120".

Liquid flow paths, such as the supply flow path 155, the first liquid flow path 151, the second liquid flow path 152, the third liquid flow path 153, the fourth liquid flow path 154, the replenishment flow path 156, and the return flow path 157 may be flow paths in which liquid can flow. For example, a liquid flow path may be a path formed inside a tube that is elastically deformable, may be a path formed inside a flow path forming member made of a hard resin, or may be a path formed by sticking a film member to a flow path forming member in which a groove is formed.

In addition, as illustrated in FIG. 4, the downstream end of the third liquid flow path 153 is connected at a position between the first intermediate storage 121 and the first check valve 161 on the first liquid flow path 151, specifically, at a position between the first open/closed valve 165 and the first check valve 161 on the first liquid flow path 151. In addition, the downstream end of the fourth liquid flow path 154 is connected at a position between the second intermediate storage 122 and the second check valve 162 on the second liquid flow path 152, specifically, at a position between the second open/closed valve 167 and the second check valve 162 on the second liquid flow path 152. In addition, one end of the return flow path 157 is connected to the liquid ejecting unit 41, and the other end thereof is connected to the supply flow path 155. The supply flow path 155 corresponds an example of a "common liquid flow path" in that the supply flow path 155 is connected to an end portion of the first liquid flow path 151 on a liquid ejecting unit 41 side and an end portion of the second liquid flow path 152 on the liquid ejecting unit 41 side in the embodiment.

Thus, the supply flow path 155, the first liquid flow path 151, and the second liquid flow path 152 are liquid flow paths that connect the intermediate storages 120 and the liquid ejecting unit 41, and are flow paths that can supply liquid from the intermediate storages 120 to the nozzles 44 of the liquid ejecting unit 41. In addition, the third liquid flow path 153, the fourth liquid flow path 154, and the replenishment flow path 156 are liquid flow paths that connect the liquid supply source 101 (liquid supply source holding unit 102) and the intermediate storages 120, and are flow paths that can supply (replenishment available) liquid to the intermediate storages 120.

The first flow rate sensor 166 detects the flow rate of liquid that flows in the first liquid flow path 151, and the second flow rate sensor 168 detects the flow rate of liquid that flows in the second liquid flow path 152. The first flow rate sensor 166 and the second flow rate sensor 168 may be electromagnetic flow meters, may be coriolis flow meters, may be ultrasonic flow meters, or may be other types of flow meter.

The first open/closed valve 165 is a valve that can be switched between an open state in which the flow of liquid inside the first liquid flow path 151 is allowed and a closed state in which the flow of liquid inside the first liquid flow path 151 is blocked. In addition, the second open/closed valve 167 is a valve that can be switched between an open state in which the flow of liquid inside the second liquid flow path 152 is allowed and a closed state in which the flow of liquid inside the second liquid flow path 152 is blocked.

By bringing the first open/closed valve 165 into a closed state, a liquid leak from the upstream end of the first liquid flow path 151 is prevented when the first intermediate storage 121 is removed from first intermediate storage holding unit 131. Similarly, by bringing the second open/closed valve 167 into a closed state, a liquid leak from the upstream end of the second liquid flow path 152 is prevented when the second intermediate storage 122 is removed from the second intermediate storage holding unit 132.

The first open/closed valve 165 and the second open/closed valve 167 may be, for example, solenoid valves, which are valves opened/closed by solenoids, may be motor-operated valves, which are valves opened/closed by electric motors, may be fluid pressure valves, which are valves opened/closed by fluid pressure cylinders, or may be other types of control valve.

While the first check valve 161 allows the flow of liquid from the first intermediate storage 121 to the liquid ejecting unit 41 on the first liquid flow path 151, the first check valve 161 restricts the flow of liquid from the liquid ejecting unit 41 to the first intermediate storage 121 on the first liquid flow path 151. While the second check valve 162 allows the flow of liquid from the second intermediate storage 122 to the liquid ejecting unit 41 on the second liquid flow path 152, the second check valve 162 restricts the flow of liquid from the liquid ejecting unit 41 to the second intermediate storage 122 on the second liquid flow path 152.

In addition, while the third check valve 163 allows the flow of liquid from the liquid supply source 101 to the first intermediate storage 121 on the third liquid flow path 153, the third check valve 163 restricts the flow of liquid from the first intermediate storage 121 to the liquid supply source 101 on the third liquid flow path 153. While the fourth check valve 164 allows the flow of liquid from the liquid supply source 101 to the second intermediate storage 122 on the fourth liquid flow path 154, the fourth check valve 164 restricts the flow of liquid from the second intermediate storage 122 to the liquid supply source 101 on the fourth liquid flow path 154.

Next, a configuration of the liquid supplying device 100 on the downstream side will be described in detail.

As illustrated in FIG. 4, the liquid supplying device 100 includes, toward the downstream side, a filter unit 210, a static mixer 220, a liquid storing unit 230, a deaerating mechanism 240, and a liquid pressure regulating mechanism 250 on the supply flow path 155. In addition, the liquid supplying device 100 includes a circulation pump 270 on the return flow path 157.

The filter unit 210 is provided on an upstream side of the liquid pressure regulating mechanism 250. The filter unit 210 includes a filter 211 that collects foreign substances in liquid flowing in the supply flow path 155 and a filter chamber 212 that accommodates the filter 211. It is preferable that the filter unit 210 be replaceable since foreign substance collecting performance declines as time of use increases. In this case, as illustrated in FIG. 2, it is preferable that the filter unit 210 be provided at a position of being exposed from the housing 12 when a cover 18 provided in the housing 12 is opened.

The static mixer 220 is provided on a downstream side of the filter unit 210. The static mixer 220 includes a plurality of configurations to divide the flow of liquid in a flowing direction of the liquid. By dividing, converting, and reversing liquid flowing in the static mixer 220, the static mixer 220 reduces a bias in the concentration of the liquid.

The liquid storing unit 230 is provided on the upstream side of the liquid pressure regulating mechanism 250, and on a downstream side of the static mixer 220. The liquid storing unit 230 has a pressurizing chamber 231 that stores liquid, an elastic film 232 that configures a part of a wall surface of the pressurizing chamber 231, and a first biasing member 233 that biases the elastic film 232 in a direction of decreasing the volume of the pressurizing chamber 231. Thus, in the liquid storing unit 230, the pressurizing chamber 231 pressurizes the liquid stored in the pressurizing chamber 231.

Herein, the pressurizing chamber 231 pressurizes the liquid stored in the pressurizing chamber 231 at a pressure (for example, 10 kPa) lower than a pressure (for example, 30 kPa) at which the intermediate storages 120 are pressurized when supplying liquid to the liquid ejecting unit 41. Specifically, a pressure that is exerted by the elastic film 232, which is biased by the first biasing member 233, on the liquid stored in the pressurizing chamber 231 is lower than a pressure exerted by the pressure regulating mechanism 140 on the intermediate storage 120 in order to supply liquid from the intermediate storage 120 to the liquid ejecting unit 41. For this reason, in a case where a pressure at which the liquid from the intermediate storage 120 is supplied does not decline to the liquid storing unit 230, the elastic film 232 is displaced in a direction where the volume of the pressurizing chamber 231 becomes larger against the biasing force of the first biasing member 233.

The deaerating mechanism 240 is provided on a downstream side of the liquid storing unit 230. The deaerating mechanism 240 includes a deaerating chamber 241 that temporarily stores liquid, a deaerating film 242 (gas-liquid separating film) that allows gas pass but does not allow liquid pass, a depressurizing chamber 243 that is partitioned with the deaerating film 242 from the deaerating chamber 241, a depressurizing flow path 244 that communicates with the depressurizing chamber 243, and a depressurizing pump 245 that depressurizes the depressurizing chamber 243.

The depressurizing chamber 243 is disposed vertically above the deaerating chamber 241 in the deaerating mechanism 240. The deaerating mechanism 240 gets rid of bubbles and dissolved gas mixed with the liquid stored in the deaerating chamber 241 by driving the depressurizing pump 245 and depressurizing the depressurizing chamber 243 through the depressurizing flow path 244. In a case where a state in which the pressure of the depressurizing chamber 243 can be made lower than the pressure of the deaerating chamber 241 with the use of a biasing member, such as a spring, the depressurizing pump 245 may not be provided.

The liquid pressure regulating mechanism 250 is provided on a downstream side of the deaerating mechanism 240. In addition, the liquid pressure regulating mechanism 250 includes a supply chamber 251 provided in the middle of the supply flow path 155, a pressure chamber 253 that can communicate with the supply chamber 251 via a communication hole 252, a valve body 254 that can open/close the communication hole 252, and a pressure receiving member 255, of which a base end side is accommodated in the supply chamber 251 and of which a tip side is accommodated in the pressure chamber 253. In addition, the liquid pressure regulating mechanism 250 includes filters 256 that filter liquid flows into the supply chamber 251.

The supply chamber 251 and the pressure chamber 253 can store liquid. A part of a wall surface of the pressure chamber 253 is formed of a flexible wall 257 that can be flexurally displaced. The valve body 254 may be, for example, a rubber or resin elastic body attached to a base end portion of the pressure receiving member 255 positioned inside the supply chamber 251.

In addition, the liquid pressure regulating mechanism 250 includes a second biasing member 258 accommodated in the supply chamber 251 and a third biasing member 259 accommodated in the pressure chamber 253. The second biasing member 258 biases the valve body 254 in a direction of closing the communication hole 252 via the pressure receiving member 255. When the flexible wall 257 pushes the pressure receiving member 255 by the flexible wall 257 being flexurally displaced in a direction of making the volume of the pressure chamber 253 smaller, the third biasing member 259 pushes the pressure receiving member 255 back.

For this reason, in a case where the internal pressure of the pressure chamber 253 declines and a force at which the flexible wall 257 pushes the pressure receiving member 255 exceeds the biasing forces of the second biasing member 258 and the third biasing member 259, the valve body 254 opens the communication hole 252. When the communication hole 252 is opened and liquid flows from the supply chamber 251 to the pressure chamber 253, the internal pressure of the pressure chamber 253 rises. As a result, before the internal pressure of the pressure chamber 253 rises so as to become positive pressure, the valve body 254 closes the communication hole 252 by means of the biasing force of the third biasing member 259. Thus, the internal pressure of the pressure chamber 253 is kept in a range of negative pressure according to the biasing force of the third biasing member 259. In addition, the internal pressure of the pressure chamber 253 declines with the discharging of liquid from the liquid ejecting unit 41. The valve body 254 independently opens/closes the communication hole 252 according to differential pressure between the external pressure of the pressure chamber 253 (atmospheric pressure) and the internal pressure of the pressure chamber 253. For this reason, the liquid pressure regulating mechanism 250 is also referred to as a differential pressure valve (or a self-sealing valve).

A valve opening mechanism 260 that forcibly opens the communication hole 252 and supplies liquid to the liquid ejecting unit 41 may be added to the liquid pressure regulating mechanism 250. For example, the valve opening mechanism 260 includes a pressure bag 262, which is accommodated in an accommodation chamber 261 partitioned with the flexible wall 257 from the pressure chamber 253, and a pressurizing flow path 263 which causes gas to flow into the pressure bag 262.

The communication hole 252 is forcibly opened by expanding the pressure bag 262 by means of the gas that flows in through the pressurizing flow path 263 and flexurally displacing the flexible wall 257 in a direction of making the volume of the pressure chamber 253 smaller. By the valve opening mechanism 260 forcibly opening the communication hole 252, pressurization cleaning, which is causing a pressurized liquid to flow out from the liquid ejecting unit 41, can be performed.

In this case, a configuration, in which the pressurizing flow path 263 is connected to the depressurizing flow path 244 and the depressurizing pump 245 can be driven so as to perform both of pressurization and depressurization, may be adopted. That is, a check valve 246 may be provided on the depressurizing flow path 244, gas may be carried to the pressure bag 262 by the depressurizing pump 245 being pressurization-driven, and the depressurizing chamber 243 may be depressurized by the depressurizing pump 245 being depressurization-driven.

The circulation pump 270 causes liquid to flow from the common liquid chamber 415 to the supply flow path 155. By driving the circulation pump 270, liquid circulates in the circulation flow path 158 configured of the supply flow path 155 and the return flow path 157. Thus, foreign substances such as bubbles are captured by the filters 211, 256, and 416 provided on the circulation flow path 158. In addition, in a case where liquid includes sedimentary components such as a pigment, the liquid is stirred by circulating the liquid or causing the static mixer 220 to pass, thereby preventing an uneven concentration.

Next, an electrical configuration of the liquid ejecting apparatus 10 will be described.

The first flow rate sensor 166 and the second flow rate sensor 168 are connected to an input side interface of the control unit 60. In addition, the transporting unit 30, the actuators 414, the wiping mechanism 52, the flushing mechanism 54, the cap mechanism 56, the pressure regulating pumps 144, the first open/closed valve 165, the second open/closed valve 167, the depressurizing pump 245, and the circulation pump 270 are connected to an output side interface of the control unit 60.

By driving the pressure regulating mechanism 140 such that gas is carried to the accommodation spaces 124 of the intermediate storages 120, the control unit 60 pressurizes the liquid accommodation units 123 of the intermediate storages 120 and supplies liquid accommodated in the intermediate storages 120 to the liquid ejecting unit 41. In addition, by driving the pressure regulating mechanism 140 such that the gas from the accommodation spaces 124 of the intermediate storages 120 is discharged, the control unit 60 depressurizes the liquid accommodation units 123 of the intermediate storages 120 and supplies liquid accommodated in the liquid supply source 101 to the intermediate storages 120.

In addition, in a case where the inside of one intermediate storage 120, out of the first intermediate storage 121 and the second intermediate storage 122, is pressurized, the control unit 60 limits the pressurization of the inside of the other intermediate storage 120. That is, in a case where liquid is supplied from one intermediate storage 120, out of the first intermediate storage 121 and the second intermediate storage 122, to the liquid ejecting unit 41, the control unit 60 limits the supply of liquid from the other intermediate storage 120 to the liquid ejecting unit 41.

In addition, in a case where the inside of one intermediate storage 120, out of the first intermediate storage 121 and the second intermediate storage 122 is depressurized, the control unit 60 limits the depressurization of the inside of the other intermediate storage 120. That is, in a case where liquid is supplied (replenishment) from the liquid supply source 101 to one intermediate storage 120, out of the first intermediate storage 121 and the second intermediate storage 122, the control unit 60 limits the supply (replenishment) of liquid from the liquid supply source 101 to the other intermediate storage 120.

In addition, the control unit 60 calculates the volumes of liquid stored in the intermediate storages 120 based on detection results from flow rate sensors 166 and 168. Specifically, in a case where liquid flows into the intermediate storage 120, the control unit 60 adds the volume of the liquid according to the flow rate thereof to the volume of the liquid stored in the intermediate storage 120 based on detection results from the flow rate sensors 166 and 168. On the other hand, in a case where liquid flows out from the intermediate storage 120, the control unit 60 subtracts the volume of the liquid according to the flow rate thereof from the volume of the liquid stored in the intermediate storage 120 based on detection results from the flow rate sensors 166 and 168. Thus, the control unit 60 figures out the volumes of liquid stored in the intermediate storages 120. In a case where the flow rate sensors 166 and 168 cannot distinguish the flowing direction of liquid, the control unit 60 may determine the flowing direction of liquid according to a driving mode of the pressure regulating mechanism 140.

When liquid is supplied from one intermediate storage 120, out of the first intermediate storage 121 and the second intermediate storage 122, to the liquid ejecting unit 41, the volume of the liquid stored in one intermediate storage 120 falls short of a liquid volume determination value, which indicates that the volume of liquid is small, in some cases. In this case, the control unit 60 stops the supply of the liquid from one intermediate storage 120 to the liquid ejecting unit 41, starts the supply of liquid from the other intermediate storage 120 to the liquid ejecting unit 41, and starts the supply of liquid from the liquid supply source 101 to one intermediate storage 120. In a case where sources (intermediate storages 120) for supplying liquid to the liquid ejecting unit 41 are switched, the control unit 60 may have a period for supplying liquid from both of the intermediate storages 120 to the liquid ejecting unit 41 in order to prevent a decline in the supply amount of liquid to the liquid ejecting unit 41.

In addition, a case where the volume of liquid stored in the intermediate storage 120 falls short of the liquid volume determination value is a case where the volume of liquid stored in the intermediate storage 120 is "0 (zero)" (for example, a case of no ink) or a case where the volume of liquid stored in the intermediate storage 120 is near "0 (zero)" (for example, a case of almost no ink). That is, a case where the volume of liquid stored in the intermediate storage 120 falls short of the liquid volume determination value is a case where liquid cannot be stably supplied from the intermediate storage 120 to the liquid ejecting unit 41. For this reason, a liquid volume determination value is set in advance according to a maximum volume of liquid that the intermediate storage 120 can store and the performance of the pressure regulating mechanism 140.

Thus, in the embodiment, in a case where liquid is supplied from the liquid supply source 101 to one intermediate storage 120 by depressurizing the inside of one intermediate storage 120, liquid is supplied to the liquid ejecting unit 41 by pressurizing the inside of the other intermediate storage 120. However, in a case where the volume of liquid stored in one intermediate storage 120 is a maximum value, the depressurization of the inside of one intermediate storage 120 may be stopped. In this case, an open/closed valve corresponding to one intermediate storage 120 (first open/closed valve 165 or second open/closed valve 167) may be in a closed state.

Next, the operation of the liquid supplying device 100 (liquid ejecting apparatus 10) of the embodiment will be described.

In the following description, the volumes of liquid stored in the first intermediate storage 121 and the second intermediate storage 122 become maximum values when the liquid ejecting unit 41 starts ejecting liquid. In addition, a source for supplying liquid to the liquid ejecting unit 41 is the first intermediate storage 121.

In the liquid ejecting apparatus 10, liquid is supplied to the liquid ejecting unit 41 by the first pressure regulating mechanism 141 pressurizing the inside of the first intermediate storage 121 in a case where liquid is ejected onto the medium M. Specifically, liquid supplied from the first intermediate storage 121 to the liquid ejecting unit 41 flows in the first liquid flow path 151 that branches off to the second liquid flow path 152 and the third liquid flow path 153. Herein, since the second check valve 162 and the third check valve 163 are provided on the second liquid flow path 152 and the third liquid flow path 153, liquid supplied from the first intermediate storage 121 to the liquid ejecting unit 41 is prevented from flowing to the liquid supply source 101 and the second intermediate storage 122.

When the volume of liquid stored in the first intermediate storage 121 falls short of the liquid volume determination value due to a continuous consumption of liquid by the liquid ejecting unit 41, the inside of the second intermediate storage 122 is pressurized by the second pressure regulating mechanism 142 and the inside of the first intermediate storage 121 is depressurized by the first pressure regulating mechanism 141. That is, a source for supplying liquid to the liquid ejecting unit 41 is switched from the first intermediate storage 121 to the second intermediate storage 122, and liquid is supplied from liquid supply source 101 to the first intermediate storage 121 which stores a decreased volume of liquid.

Specifically, liquid supplied from the second intermediate storage 122 to the liquid ejecting unit 41 flows in the second liquid flow path 152 that branches off to the first liquid flow path 151 and the fourth liquid flow path 154. Herein, since the first check valve 161 and the fourth check valve 164 are provided on the first liquid flow path 151 and the fourth liquid flow path 154, liquid supplied from the second intermediate storage 122 to the liquid ejecting unit 41 is prevented from flowing to the liquid supply source 101 and the first intermediate storage 121.

In addition, liquid supplied from the liquid supply source 101 to the first intermediate storage 121 flows in the third liquid flow path 153, which branches off to the fourth liquid flow path 154, and the first liquid flow path 151, which is connected to the supply flow path 155. Herein, since the fourth check valve 164 is provided on the fourth liquid flow path 154, liquid is prevented from flowing from the second intermediate storage 122 to the first intermediate storage 121 via the fourth liquid flow path 154. In addition, since the first check valve 161 is provided on the first liquid flow path 151, liquid is prevented from flowing from the liquid ejecting unit 41 side to the first intermediate storage 121 via the first liquid flow path 151.

When the volume of liquid stored in the second intermediate storage 122 falls short of the liquid volume determination value due to a continuous consumption of liquid by the liquid ejecting unit 41 after a source for supplying liquid to the liquid ejecting unit 41 is switched to the second intermediate storage 122, a source for supplying liquid to the liquid ejecting unit 41 is switched to the first intermediate storage 121. In addition, liquid is supplied from the liquid supply source 101 to the second intermediate storage 122, which stores a decreased volume of liquid.

Thus, according to the liquid ejecting apparatus 10 of the embodiment, even in a case where the volume of liquid stored in one intermediate storage 120, out of the first intermediate storage 121 and the second intermediate storage 122, falls short of the liquid volume determination value, liquid is supplied from the other intermediate storage 120 to the liquid ejecting unit 41. In addition, by supplying liquid from the liquid supply source 101 to one intermediate storage 120, of which the volume of a stored liquid falls short of the liquid volume determination value, the volume of a stored liquid is increased.

According to the first embodiment described hereinbefore, the following effects can be obtained.

(1) According to the embodiment, liquid can be supplied from the first intermediate storage 121 to the liquid ejecting unit 41 via the first liquid flow path 151 or liquid can be supplied from the second intermediate storage 122 to the liquid ejecting unit 41 via the second liquid flow path 152. In addition, in a case where the volume of liquid stored in the first intermediate storage 121 or the second intermediate storage 122 becomes smaller, liquid can be supplied (replenishment) from the liquid supply source 101 to the first intermediate storage 121 or the second intermediate storage 122 by the pressure regulating mechanism 140 depressurizing the inside of the first intermediate storage 121 or the inside of the second intermediate storage 122.

That is, in a case where liquid is supplied to one intermediate storage 120 by depressurizing the inside of the one intermediate storage 120, out of the first intermediate storage 121 and the second intermediate storage 122, the inside of the other intermediate storage 120 is not depressurized. That is, in a case where liquid is supplied to one intermediate storage 120, liquid can be supplied from the other intermediate storage 120 to the liquid ejecting unit 41. Therefore, even when liquid is being supplied to one intermediate storage 120, liquid can be ejected from the liquid ejecting unit 41 due to the supply of liquid from the other intermediate storage 120.

(2) In a case where liquid is supplied from the liquid supply source 101 to the first intermediate storage 121, the first check valve 161 prevents liquid from flowing from the liquid ejecting unit 41 to the first intermediate storage 121, and the fourth check valve 164 prevents liquid from flowing from the second intermediate storage 122 to the first intermediate storage 121. In addition, in a case where liquid is supplied from the first intermediate storage 121 to the liquid ejecting unit 41, the third check valve 163 prevents liquid from flowing from the first intermediate storage 121 to the liquid supply source 101, and the second check valve 162 prevents liquid from flowing from the first intermediate storage 121 to the second intermediate storage 122. Except for the fact that functioning check valves are different, the same applies to a case where liquid is supplied from the liquid supply source 101 to the second intermediate storage 122 or a case where liquid is supplied from the second intermediate storage 122 to the liquid ejecting unit 41.

Therefore, an operation of supplying liquid from the liquid supply source 101 to one intermediate storage 120 can be prevented from affecting an operation of supplying liquid from the other intermediate storage 120 to the liquid ejecting unit 41. In addition, an operation of supplying liquid from one intermediate storage 120 to the liquid ejecting unit 41 can be prevented from affecting an operation of supplying liquid from the liquid supply source 101 to the other intermediate storage 120.

(3) Since the intermediate storages 120 are detachable with respect to the intermediate storage holding units 131 and 132, the intermediate storages 120 can be removed from the liquid supplying device 100 in order to replace the intermediate storages 120 or in order for a user to stir the intermediate storages 120. In addition, in a case where the first intermediate storage 121 and the second intermediate storage 122 are removed from the liquid supplying device 100, liquid can be prevented from leaking from the first liquid flow path 151 and the second liquid flow path 152 by bringing the first open/closed valve 165 and the second open/closed valve 167 into a closed state.

(4) Since the bag-like liquid accommodation units 123 of the intermediate storages 120 are accommodated in the accommodation spaces 124 of the cases 125, liquid can be supplied from the liquid supply source 101 to the liquid accommodation units 123 by depressurizing the accommodation spaces 124. In addition, since liquid accommodated in the liquid accommodation units 123 does not come into contact with outside air, a possibility that the liquid accommodated in the liquid accommodation units 123 comes into contact with outside air and deteriorates can be reduced.

(5) The liquid pressure regulating mechanism 250 prevents fluctuations in the pressure of liquid flowing in the supply flow path 155 to the liquid pressure regulating mechanism 250, and the supply of liquid to the liquid ejecting unit 41 can be stably performed. For example, when liquid is supplied from the liquid supply source 101 to the intermediate storage 120, the volume of the pressure chamber 253 fluctuates in a case where fluctuations in the pressure of liquid flowing in a liquid flow path, such as the first liquid flow path 151 and the second liquid flow path 152, occur under the circumstances where the supply chamber 251 of the liquid pressure regulating mechanism 250 and the pressure chamber 253 of the liquid pressure regulating mechanism 250 communicate with each other. Thus, it can be prevented that fluctuations in the pressure of liquid on the upstream side of the liquid pressure regulating mechanism 250 affect the downstream side of the liquid pressure regulating mechanism 250.

In particular, the liquid pressure regulating mechanism 250 of the embodiment allows the supply chamber 251 on the upstream side and the pressure chamber 253 on the downstream side to communicate with each other in a case where the pressure (internal pressure) of the pressure chamber 253 declines. For this reason, under the circumstances where the supply chamber 251 and the pressure chamber 253 do not communicate with each other, it can be prevented that fluctuations in the pressure of the upstream side of the liquid pressure regulating mechanism 250, which is caused by an operation of supplying liquid to the intermediate storages 120 and an operation of supplying liquid from the intermediate storages 120, affect the downstream side of the liquid pressure regulating mechanism 250.

(6) Liquid including foreign substances can be prevented from being supplied to the liquid ejecting unit 41 and the liquid pressure regulating mechanism 250 by providing the filter unit 210 on the supply flow path 155.

(7) Since liquid can be supplied from one intermediate storage 120 to the liquid ejecting unit 41 in the midst of the supply of liquid from the liquid supply source 101 to the other intermediate storage 120, the volumes of liquid stored in both of the intermediate storages 120 are unlikely to become smaller at the same time, and the supply of liquid to the liquid ejecting unit 41 can be continuously performed.

(8) In a case where a large amount of liquid is consumed by the liquid ejecting unit 41 in a short period of time, a pressure loss of a flow path ranging from the intermediate storage 120 to the liquid ejecting unit 41 occurs, and thereby the supply amount of liquid from the intermediate storage 120 to the liquid ejecting unit 41 does not catch up with the amount of liquid consumed by the liquid ejecting unit 41. In this regard, since the pressurizing chamber 231 is provided on the upstream side of the liquid pressure regulating mechanism 250 in the embodiment, liquid is supplied from the pressure chamber 253 to the liquid ejecting unit 41 in a case where the supply amount of liquid from the intermediate storage 120 to the liquid ejecting unit 41 does not catch up with the amount of liquid consumed by the liquid ejecting unit 41, that is, in a case where pressure of liquid inside the pressurizing chamber 231 declines. For this reason, liquid can be stably supplied to the liquid ejecting unit 41.

Second Embodiment

Next, a liquid ejecting apparatus of a second embodiment will be described with reference to the drawings. The liquid ejecting apparatus of the second embodiment has the same configuration as that of the first embodiment but a method for controlling a pressure regulating mechanism is different from the first embodiment. For this reason, configurations which are the same as those of the first embodiment will be assigned with the same reference signs and overlapping description will be omitted.

As illustrated in FIG. 4, the liquid supply source holding unit 102 detachably holds the replaceable cartridge-type liquid supply source 101. The liquid supply source holding unit 102 is connected to the first intermediate storage 121 and the second intermediate storage 122 such that liquid accommodated in the mounted liquid supply source 101 can be supplied to the first intermediate storage 121 and the second intermediate storage 122. The second liquid flow path 152 on which the second intermediate storage 122 is provided can supply liquid to the liquid ejecting unit 41 without going through the first intermediate storage 121.

Figures 5, 6:
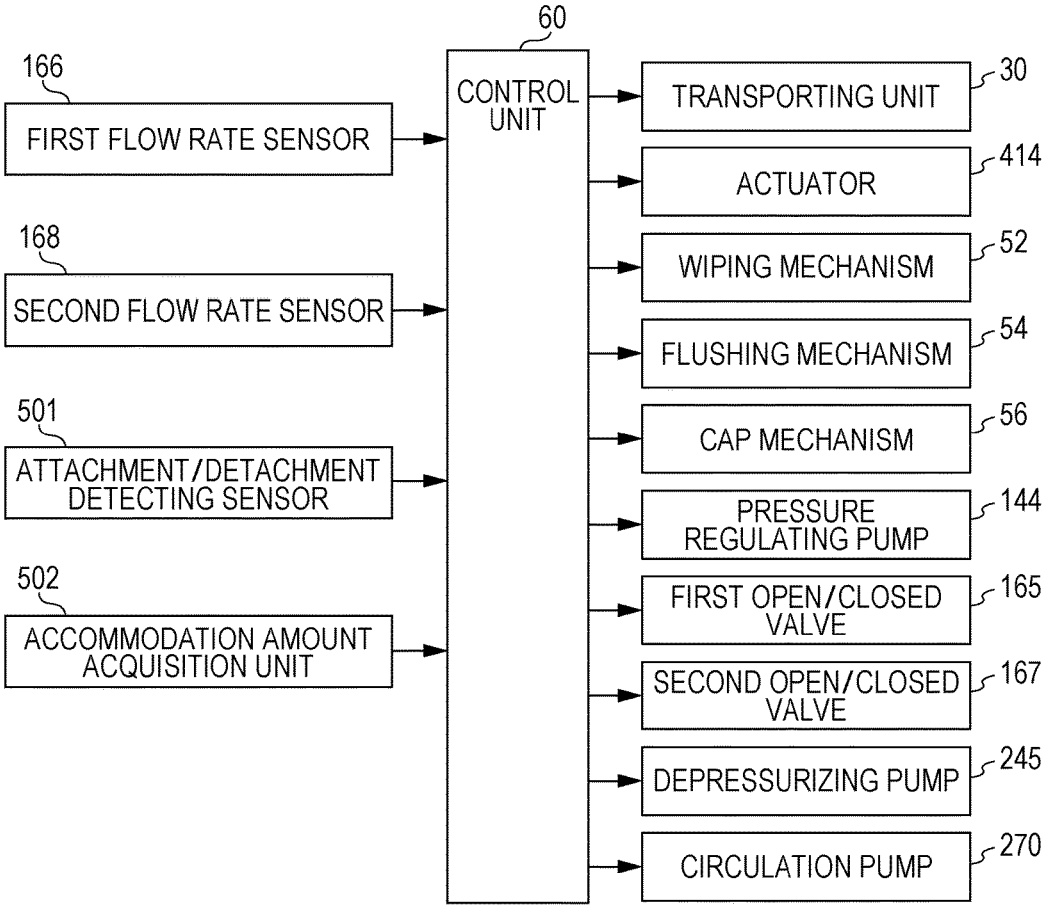
FIG. 5 is a block diagram of a control unit according to a second embodiment.
FIG. 6 is a table showing supply control of the liquid ejecting apparatus.

As illustrated in FIG. 5, the liquid ejecting apparatus 10 includes an attachment/detachment detecting sensor 501 that detects the attachment/detachment of the liquid supply source 101 with respect to the liquid supply source holding unit 102 and an accommodation amount acquisition unit 502 that acquires the amount of liquid accommodated in the liquid supply source 101. For example, the accommodation amount acquisition unit 502 is a sensor that detects the amount of liquid accommodated in the liquid supply source 101 (for example, a weight sensor that can measure the weight of the liquid supply source 101).

The attachment/detachment detecting sensor 501 and the accommodation amount acquisition unit 502 are connected to the input side interface of the control unit 60. In a case where another liquid supply source 101 is mounted on the liquid supply source holding unit 102, which is in a state where the liquid supply source 101 is taken out, the control unit 60 detects the replacement of the liquid supply source 101.

The control unit 60 depressurizes the inside of one intermediate storage 120, out of the first intermediate storage 121 and the second intermediate storage 122, to supply liquid from the liquid supply source 101 to one intermediate storage 120. At this time, the control unit 60 pressurizes the inside of the other intermediate storage 120 to supply liquid from the other intermediate storage 120 to the liquid ejecting unit 41. The control unit 60 controls the pressure regulating mechanism 140 such that the inside of one intermediate storage 120 is depressurized and an operation of supplying, which is depressurizing the inside of the other intermediate storage 120, is alternately repeated with respect to the first intermediate storage 121 and the second intermediate storage 122.

In a case where the accommodation space 124 is depressurized and a storage amount inside the intermediate storage 120, to which liquid from the liquid supply source 101 is supplied, is a first set value, the control unit 60 stops depressurizing the inside of the intermediate storage 120. In a case where the accommodation space 124 is pressurized and a storage amount inside the intermediate storage 120, which supplies liquid to the liquid ejecting unit 41, is a second set value that is lower than the first set value, the control unit 60 depressurizes the inside of the intermediate storage 120.

Storage amounts inside the intermediate storages 120 are the volumes of liquid stored in the intermediate storages 120. A case where the storage amount is the first set value is a case where the volume of liquid stored in the intermediate storage 120 is a maximum value (for example, a case where the storage is full) or a case where the volume of liquid stored in the intermediate storage 120 is near a maximum value (for example, a case where the storage is nearly full). The first set value is a value set in advance according to a maximum volume of liquid that can be stored in the intermediate storage 120. The second set value is the same as the liquid volume determination value in the first embodiment.

Next, supply control will be described.

As illustrated in FIG. 6, the control unit 60 performs first supply control and second supply control according to a speed at which liquid is consumed by the liquid ejecting unit 41.

For example, in the case of a printer, the consumption flow rate of liquid (the amount of liquid consumed per unit time) changes according to a print duty value indicating a percentage (%) of a printed area (filled with the ejected liquid) per unit area on the medium M. That is, as the print duty value becomes higher, the consumption flow rate of liquid becomes higher. In addition, the consumption flow rate of liquid changes according to a print mode. In a high-speed print mode where a print speed takes precedence over a print quality, the consumption flow rate of liquid is high compared to a low-speed print mode where a print quality takes precedence over a print speed.

In the following description, a storage amount inside one intermediate storage 120 will be referred to as one storage amount, and a storage amount inside the other intermediate storage 120 will be referred to as the other storage amount. In the embodiment, control, which is performed in a case where the other storage amount becomes the second set value after one storage amount becomes the first set value, is the first supply control, and control, which is performed in a case where the other storage amount becomes the second set value before one storage amount becomes the first set value, is the second supply control.

The control unit 60 performs the first supply control in a case where the consumption flow rate of liquid is small, and controls the pressure regulating mechanism 140 such that the inside of one intermediate storage 120 and the inside of the other intermediate storage 120 are depressurized in turn at a first pressure (for example, −15 kPa). The first pressure is set to a value at which the flow rate of liquid supplied from the liquid supply source 101 to the intermediate storage 120 (the amount of liquid supplied per unit time) is higher than a consumption flow rate at the time of normal printing (for example, a print duty value is 5% in the low-speed print mode) when the inside of the intermediate storage 120 is depressurized at the first pressure.

In the first supply control, the control unit 60 pressurizes the inside of the other intermediate storage 120 to supply liquid, depressurizes the inside of one intermediate storage 120 at the first pressure, and stops depressurizing the inside of one intermediate storage 120 in a case where one storage amount becomes the first set value. After then, the control unit 60 depressurizes the inside of the other intermediate storage 120 at the first pressure in a case where the other storage amount becomes the second set value. At this time, the control unit 60 pressurizes the inside of one intermediate storage 120 to supply liquid from one intermediate storage 120 to the liquid ejecting unit 41.

The control unit 60 performs the second supply control in a case where the consumption flow rate of liquid is higher than supply flow rate when the inside of the intermediate storage 120 is depressurized at the first pressure. In the second supply control, the control unit 60 controls the pressure regulating mechanism 140 such that the inside of one intermediate storage 120 is depressurized at the first pressure, and the inside of the other intermediate storage 120 is depressurized at a second pressure (for example, −35 kPa), which has a larger degree of depressurization than the first pressure.

Specifically, the control unit 60 pressurizes the inside of the other intermediate storage 120 to supply liquid, and depressurizes the inside of one intermediate storage 120 at the first pressure. The control unit 60 stops depressurizing the inside of one intermediate storage 120 in a case where the other storage amount becomes the second set value while depressurizing one intermediate storage 120. Furthermore, the control unit 60 depressurizes the inside of the other intermediate storage 120 at the second pressure, and pressurizes the inside of one intermediate storage 120 to supply liquid from one intermediate storage 120 to the liquid ejecting unit 41.

As described above, the control unit 60 controls the pressure regulating mechanism 140 such that the degree of depressurization of the inside of the other intermediate storage 120 in the second supply control becomes larger than the degree of depressurization of the inside of the other intermediate storage 120 in the first supply control.

Flow rate at which liquid is supplied from the liquid supply source 101 to the intermediate storage 120 becomes higher as the degree of depressurization of the inside of the intermediate storage 120 becomes larger. That is, supply flow rate when the inside of the intermediate storage 120 is depressurized at the second pressure is higher than supply flow rate when the inside of the intermediate storage 120 is depressurized at the first pressure. The second pressure may be set to a value at which the supply flow rate when the inside of the intermediate storage 120 is depressurized at the second pressure is higher than a maximum consumption flow rate in the liquid ejecting unit 41.

Next, a liquid supplying method will be described with reference to flow chart shown in FIG. 7 and FIG. 8.

Figure 7:
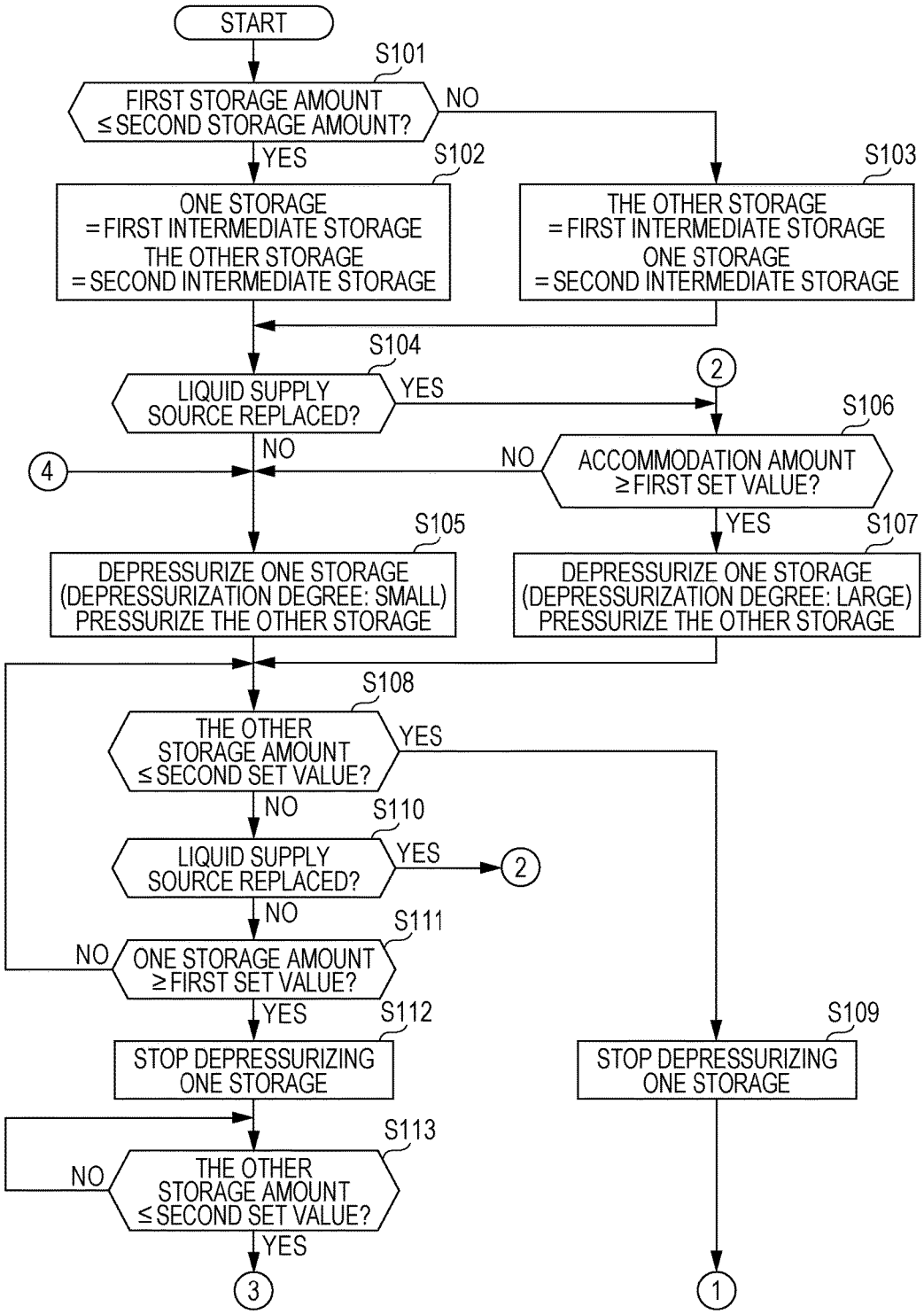
FIG. 7 is a flow chart of liquid supplying routine.
Figure 8:
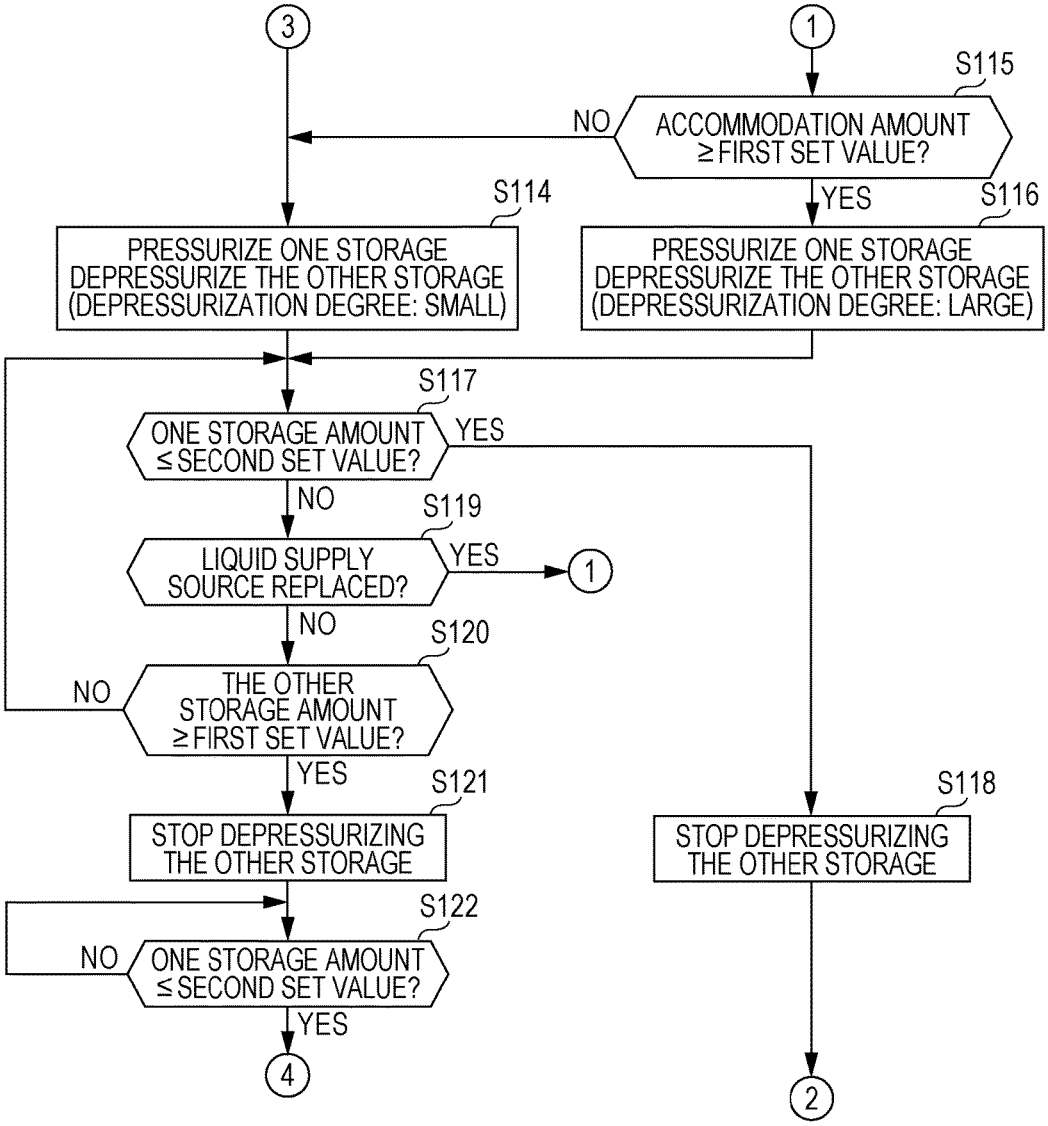
FIG. 8 is a flow chart of the liquid supplying routine.

In the flow chart shown in FIG. 7 and FIG. 8, Step S114, which is performed by going through Step S105, Step S108, and Step S111 to Step S113, corresponds to the first supply control. In addition, Step S116, which is performed by going through Step S105, Step S108, and Step S109, corresponds to the second supply control.

This liquid supplying routine is executed at timing when the liquid ejecting apparatus 10 is turned on, and is terminated when the power is turned off. In the flow chart shown in FIG. 7 and FIG. 8, the one intermediate storage 120 will be referred to as "one storage", and the other intermediate storage 120 will be referred to as "the other storage".

As shown in FIG. 7, in Step S101, the control unit 60 determines whether or not a first storage amount, which is the volume of liquid stored in the first intermediate storage 121, is equal to or smaller than a second storage amount, which is the volume of liquid stored in the second intermediate storage 122.

In a case where the first storage amount is equal to or smaller than the second storage amount (Step S101: YES), the control unit 60 sets the first intermediate storage 121 as one intermediate storage 120 and sets the second intermediate storage 122 as the other intermediate storage 120 in Step S102. In a case where the first storage amount is larger than the second storage amount (Step S101: NO), the control unit 60 sets the first intermediate storage 121 as the other intermediate storage 120 and sets the second intermediate storage 122 as one intermediate storage 120 in Step S103.

In Step S104, the control unit 60 determines whether or not the liquid supply source 101 is replaced. In a case where the liquid supply source 101 is not replaced (Step S104: NO), the control unit 60 depressurizes the inside of one intermediate storage 120 at the first pressure and pressurizes the inside of the other intermediate storage 120 in Step S105.

In a case where the liquid supply source 101 is replaced in Step S104 (Step S104: YES), the control unit 60 determines whether or not an accommodation amount in the liquid supply source 101 is equal to or larger than the first set value in Step S106. In a case where the accommodation amount falls short of the first set value (Step S106: NO), the control unit 60 takes the processing to Step S105.

In a case where the accommodation amount is equal to or larger than the first set value in Step S106 (Step S106: YES), the control unit 60 depressurizes the inside of one intermediate storage 120 at the second pressure, which has a larger degree of depressurization than the first pressure, and pressurizes the inside of the other intermediate storage 120 in Step S107. Liquid is supplied from the liquid supply source 101 to one intermediate storage 120, which is depressurized, and a storage amount thereof increases. The other intermediate storage 120, which is pressurized, supplies liquid to the liquid ejecting unit 41 and a storage amount thereof decreases.

In Step S108, the control unit 60 determines whether or not the other storage amount is equal to or smaller than the second set value. In a case where the other storage amount is equal to or smaller than the second set value (Step S108: YES), the control unit 60 stops depressurizing the inside of one intermediate storage 120 in Step S109 and takes the processing to Step S115 (refer to FIG. 8).

In a case where the other storage amount is larger than the second set value in Step S108 (Step S108: NO), the control unit 60 determines whether or not the liquid supply source 101 is replaced in Step S110. In a case where the liquid supply source 101 is replaced (Step S110: YES), the control unit 60 takes the processing to Step S106.

In a case where the liquid supply source 101 is not replaced in Step S110 (Step S110: NO), the control unit 60 determines whether or not one storage amount is equal to or larger than the first set value in Step S111. In a case where one storage amount falls short of the first set value (Step S111: NO), the control unit 60 takes the processing to Step S108.

In a case where one storage amount is equal to or larger than the first set value in Step S111, (Step S111: YES), the control unit 60 stops depressurizing the inside of one intermediate storage 120 in Step S112.

In Step S113, the control unit 60 determines whether or not the other storage amount is equal to or smaller than the second set value. In a case where the other storage amount is larger than the second set value (Step S113: NO), the control unit 60 stands by until the other storage amount becomes equal to or smaller than the second set value. When the other storage amount is equal to or smaller than the second set value (Step S113: YES), the control unit 60 takes the processing to Step S114.

As shown in FIG. 8, the control unit 60 pressurizes the inside of one intermediate storage 120 and depressurizes the inside of the other intermediate storage 120 at the first pressure in Step S114. In addition, the control unit 60 determines whether or not an accommodation amount in the liquid supply source 101 is equal to or larger than the first set value in Step S115. In a case where the accommodation amount falls short of the first set value (Step S115: NO), the control unit 60 takes the processing to Step S114.

In a case where the accommodation amount is equal to or larger than the first set value in Step S115, (Step S115: YES), the control unit 60 pressurizes the inside of one intermediate storage 120 and depressurizes the inside of the other intermediate storage 120 at the second pressure, which has a larger degree of depressurization than the first pressure, in Step S116.

That is, in a case where the amount of liquid accommodated in the liquid supply source 101 is equal to or larger than the first set value, the control unit 60 performs the second supply control. In a case where the accommodation amount falls short of the first set value, the control unit 60 controls the pressure regulating mechanism 140 such that the inside of the other intermediate storage 120 is depressurized at a pressure equivalent to a pressure in the first supply control. One intermediate storage 120, which is pressurized, supplies liquid to the liquid ejecting unit 41 and a storage amount thereof decreases. Liquid is supplied from the liquid supply source 101 to the other intermediate storage 120, which is depressurized, and a storage amount thereof increases.

In Step S117, the control unit 60 determines whether or not one storage amount is equal to or smaller than the second set value. In a case where one storage amount is equal to or smaller than the second set value (Step S117: YES), the control unit 60 stops depressurizing the inside of the other intermediate storage 120 in Step S118, and takes the processing to Step S106 (refer to FIG. 7).

In a case where one storage amount is larger than the second set value in Step S117, (Step S117: NO), the control unit 60 determines whether or not the liquid supply source 101 is replaced in Step S119. In a case where the liquid supply source 101 is replaced (Step S119: YES), the control unit 60 takes the processing to Step S115.

In a case where the liquid supply source 101 is not replaced in Step S119 (Step S119: NO), the control unit 60 determines whether or not the other storage amount is equal to or larger than the first set value in Step S120. In a case where the other storage amount falls short of the first set value (Step S120: NO), the control unit 60 takes the processing to Step S117.

In a case where the other storage amount is equal to or larger than the first set value in Step S120 (Step S120: YES), the control unit 60 stops depressurizing the inside of the other intermediate storage 120 in Step S121.

In Step S122, the control unit 60 determines whether or not one storage amount is equal to or smaller than the second set value. In a case where one storage amount is larger than the second set value (Step S122: NO), the control unit 60 stands by until one storage amount becomes equal to or smaller than the second set value. When one storage amount is equal to or smaller than the second set value (Step S122: YES), the control unit 60 takes the processing to Step S105.

Next, the operation of the liquid supplying device 100 (liquid ejecting apparatus 10) of the embodiment will be described.

In a case where the liquid supply source 101 held by the liquid supply source holding unit 102 is replaced with another liquid supply source 101, the control unit 60 controls the pressure regulating mechanism 140 such that the degree of depressurization inside the intermediate storage 120 is larger than the degree of depressurization before the liquid supply source 101 is replaced. In a case where the liquid supply source 101 is replaced, the control unit 60 may make the degree of depressurization at which the inside of the intermediate storage 120 is depressurized larger regardless of whether or not to perform the second supply control.

That is, in a case where the liquid supply source 101 is replaced while the intermediate storage 120 is being depressurized at the first pressure, the control unit 60 changes a pressure at which the intermediate storage 120 is depressurized from the first pressure to the second pressure. In addition, in a case where the liquid supply source 101 is replaced in a state where the liquid ejecting apparatus 10 is turned off, the control unit 60 depressurizes the inside of one intermediate storage 120 at the second pressure when the liquid supply source 101 is turned on. However, in a case where the amount of liquid accommodated in the newly replaced liquid supply source 101 is smaller than the first set value, the control unit 60 depressurizes the inside of one intermediate storage 120 at the first pressure.

According to the second embodiment, the following effects can be obtained in addition to the effects of the first embodiment.

(2-1) The pressure regulating mechanism 140 depressurizes the inside of one intermediate storage 120, out of the first intermediate storage 121 and the second intermediate storage 122, to supply liquid from the liquid supply source 101 to one intermediate storage 120 and to supply liquid from the other intermediate storage 120 to the liquid ejecting unit 41. When a storage amount inside the other intermediate storage 120 becomes the second set value, the pressure regulating mechanism 140 stops depressurizing the inside of one intermediate storage 120 and supplies liquid from one intermediate storage 120 to the liquid ejecting unit 41 even when the inside of one intermediate storage 120 is being depressurized. Therefore, a period when liquid cannot be supplied from the intermediate storage 120, which stores liquid supplied from the liquid supply source 101, to the liquid ejecting unit 41 can be prevented from occurring.

(2-2) The degree of depressurization of the inside of the other intermediate storage 120 in the second supply control is larger than the degree of depressurization of the inside of the other intermediate storage 120 in the first supply control. That is, the control unit 60 makes the degree of depressurization larger only in case where liquid supplied from the intermediate storage 120 to the liquid ejecting unit 41 is insufficient. Therefore, liquid can be continuously supplied from the intermediate storage 120 to the liquid ejecting unit 41 while maintaining the durability of the intermediate storage 120.

(2-3) The control unit 60 performs the second supply control in a case where the accommodation amount of liquid stored in the liquid supply source 101 is equal to or larger than the first set value. For this reason, a possibility that liquid cannot be supplied from liquid supply source 101 to the intermediate storage 120 before storage amount inside the intermediate storage 120 becomes the first set value can be reduced.

(2-4) The liquid supply source 101 is often replaced in a case where the amount of an accommodated liquid is small or is zero. For this reason, in a case where the liquid supply source 101 is replaced, the storage amount inside the intermediate storage 120 has decreased in some cases. In that respect, in a case where the liquid supply source 101 is replaced, the control unit 60 controls the pressure regulating mechanism 140 such that the degree of depressurization inside the intermediate storage 120 is larger than the degree before the liquid supply source 101 is replaced. Therefore, a possibility that liquid to be supplied from the intermediate storage 120 to the liquid ejecting unit 41 is insufficient can be reduced.

(2-5) In a case where the consumption flow rate of liquid is low in the liquid ejecting unit 41, the intermediate storage 120 is depressurized at the first pressure, which has a small degree of depressurization. For this reason, for example, in the case of the intermediate storages 120 that include the bag-like liquid accommodation units 123, the occurrence of degradation of the liquid accommodation units 123 due to repeated volume changes can be reduced.

Third Embodiment

Next, a liquid ejecting apparatus of a third embodiment will be described with reference to the drawings. The liquid ejecting apparatus of the third embodiment has substantially the same configuration as that of the second embodiment. For this reason, configurations which are the same as those of the first embodiment and the second embodiment will be assigned with the same reference signs and overlapping description will be omitted.

Figure 9:
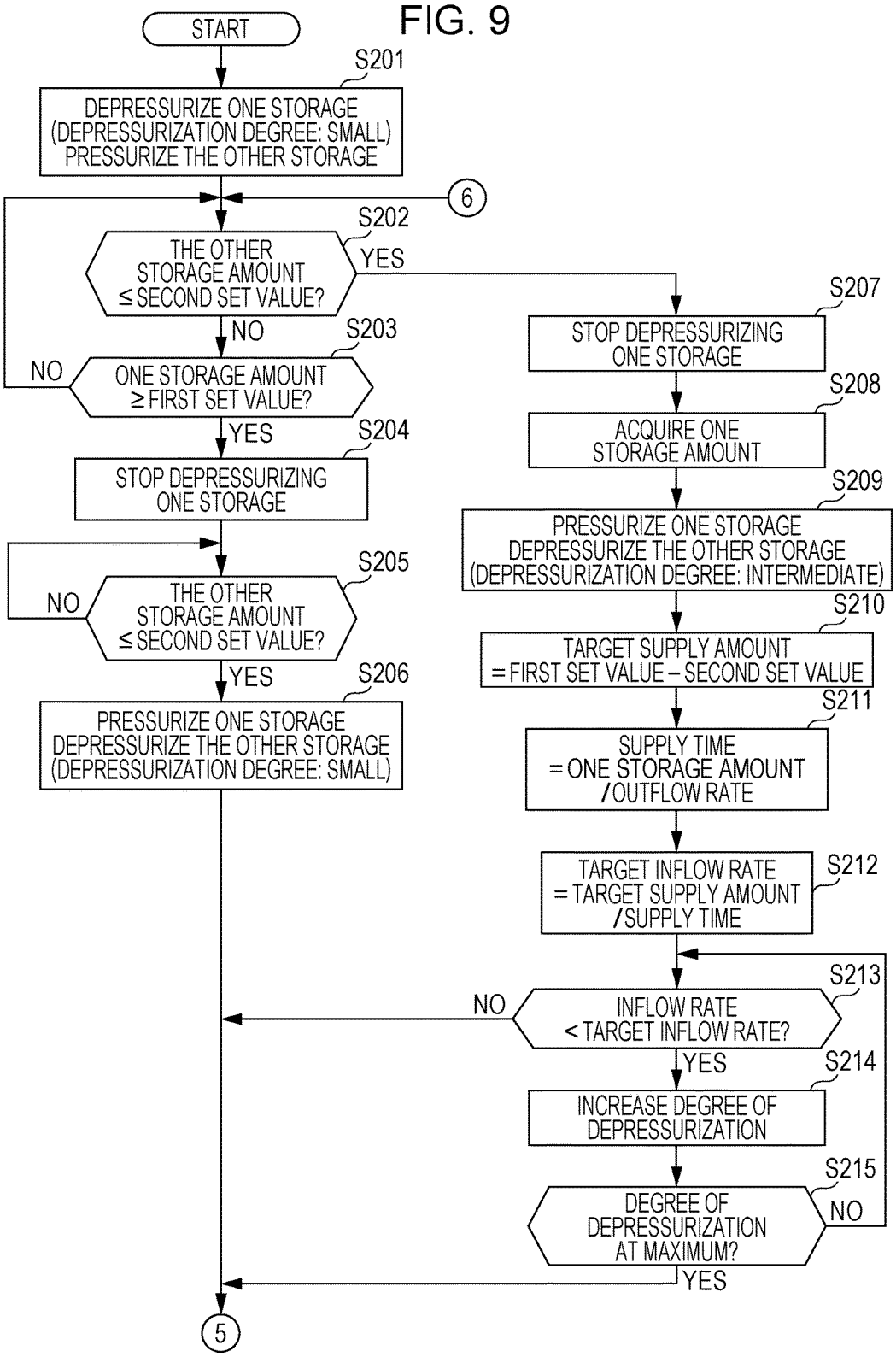
FIG. 9 is a flow chart of liquid supplying routine of a third embodiment.
Figure 10:
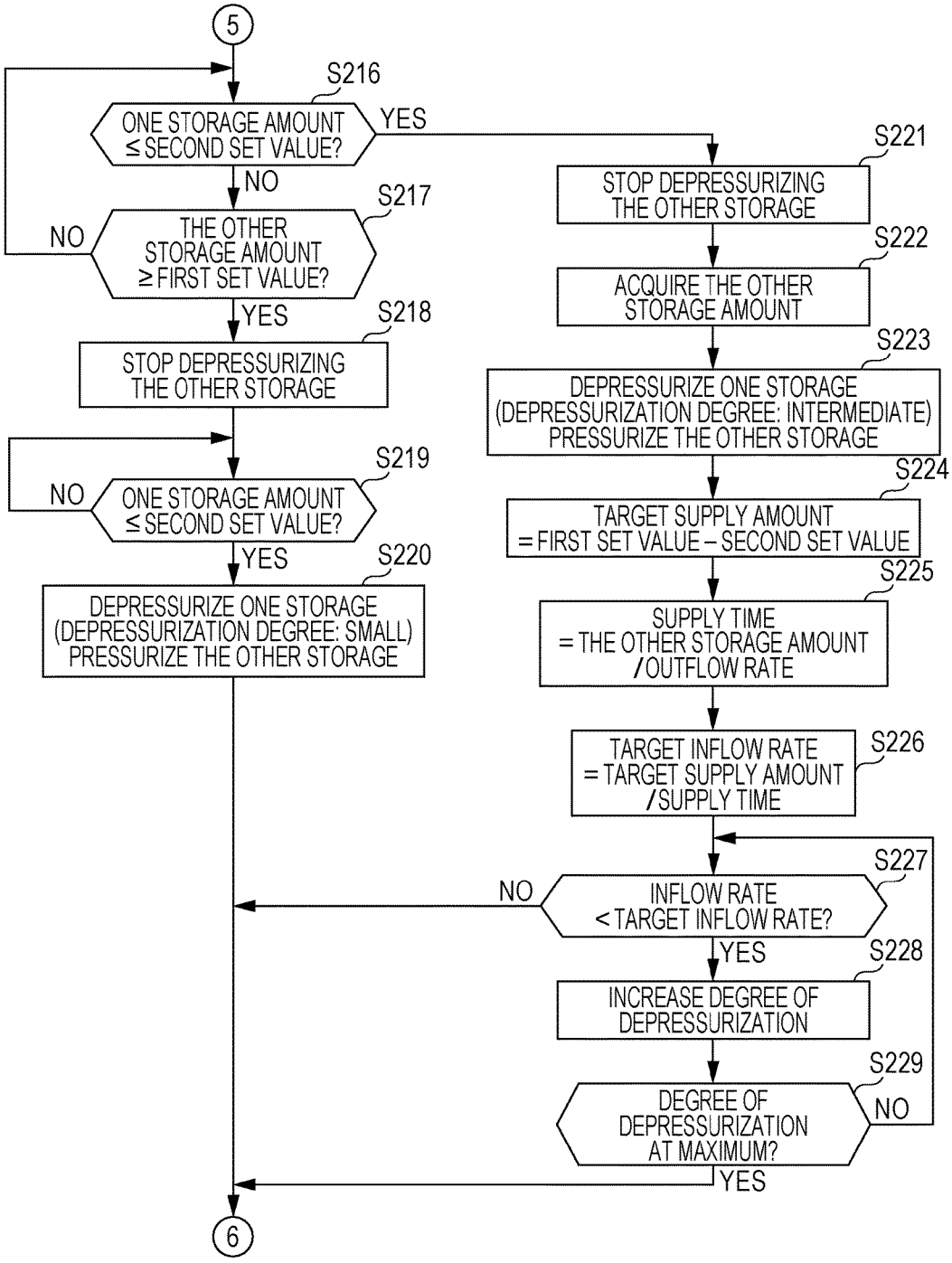
FIG. 10 is a flow chart of the liquid supplying routine.

Liquid supplying routine shown in FIG. 9 and FIG. 10 is executed at timing when the liquid ejecting apparatus 10 is turned on as in the second embodiment and is terminated when the power is turned off. Out of the first intermediate storage 121 and the second intermediate storage 122, the control unit 60 sets a storage, of which a storage amount is smaller when executing the liquid supplying routine, as one intermediate storage 120, and a storage, of which a storage amount is larger, is set as the other intermediate storage 120.

In the following description, flow rate of liquid flowing into the intermediate storage 120 from the liquid supply source 101 will be referred to as inflow rate, and flow rate of liquid flowing out from the intermediate storage 120 so as to be supplied to the liquid ejecting unit 41 will be referred to as outflow rate, both of which are detected by the first flow rate sensor 166 and the second flow rate sensor 168. Outflow rate corresponds to consumption flow rate.

As shown in FIG. 9, in Step S201, the control unit 60 depressurizes the inside of one intermediate storage 120 and pressurizes the inside of the other intermediate storage 120. At this time, the control unit 60 depressurizes the inside of one intermediate storage 120 at the first pressure (for example, −15 kPa).

In Step S202, the control unit 60 determines whether or not the other storage amount is equal to or smaller than the second set value. In Step S202, in a case where the other storage amount is larger than the second set value (Step S202: NO), the control unit 60 determines whether or not one storage amount is equal to or larger than the first set value in Step S203. In a case where one storage amount falls short of the first set value (Step S203: NO), the control unit 60 takes the processing to Step S202.

In a case where one storage amount is equal to or larger than the first set value in Step S203 (Step S203: YES), the control unit 60 stops depressurizing the inside of one intermediate storage 120 in Step S204.

In Step S205, the control unit 60 determines whether or not the other storage amount is equal to or smaller than the second set value. In a case where the other storage amount is larger than the second set value (Step S205: NO), the control unit 60 stands by until the other storage amount becomes equal to or smaller than the second set value. In a case where the other storage amount is equal to or smaller than the second set value (Step S205: YES), the control unit 60 pressurizes the inside of one intermediate storage 120 and depressurizes the inside of the other intermediate storage 120 in Step S206. At this time, the control unit 60 depressurizes the inside of the other intermediate storage 120 at the first pressure.

In a case where the other storage amount is equal to or smaller than the second set value in Step S202 (Step S202: YES), the control unit 60 stops depressurizing the inside of one intermediate storage 120 in Step S207. In Step S208, the control unit 60 acquires one storage amount. In Step S209, the control unit 60 pressurizes the inside of one intermediate storage 120 and depressurizes the inside of the other intermediate storage 120. At this time, the control unit 60 depressurizes the inside of the other intermediate storage 120 at a third pressure (for example, −20 kPa), which has a larger degree of depressurization than the first pressure (for example, −15 kPa) and has a smaller degree of depressurization than the second pressure (for example, −35 kPa).

In Step S210, the control unit 60 calculates a target supply amount to be supplied to the other intermediate storage 120. A target supply amount is a difference between the first set value and the second set value in the other intermediate storage 120.

In Step S211, the control unit 60 calculates supply time for which liquid can be supplied from the liquid supply source 101 to the other intermediate storage 120. Supply time is time from the start of the pressurization of the inside of one intermediate storage 120 until one storage amount becomes equal to or lower than the second set value. The control unit 60 calculates supply time by dividing one storage amount acquired in Step S208 by the outflow rate of liquid flowing out from one intermediate storage 120.

In Step S212, the control unit 60 calculates the target inflow rate of liquid flowing from the liquid supply source 101 into the other intermediate storage 120. Specifically, the control unit 60 calculates the target inflow rate by dividing the target supply amount calculated in Step S210 by the supply time calculated in Step S208.

In Step S213, the control unit 60 determines whether or not inflow rate detected by the first flow rate sensor 166 or the second flow rate sensor 168 falls short of the target inflow rate. In a case where the inflow rate falls short of the target inflow rate (Step S213: YES), the control unit 60 makes the degree of depressurization at which the inside of the other intermediate storage 120 is depressurized larger in Step S214.

In Step S215, the control unit 60 determines whether or not the degree of depressurization is a maximum value (for example, −35 kPa). In a case where the degree of depressurization is not a maximum value (Step S215: NO), the control unit 60 takes the processing to Step S213.

In a case where the inflow rate is equal to or higher than the target inflow rate in Step S213 (Step S213: NO), the control unit 60 takes the processing to Step S216. In a case where the degree of depressurization is a maximum value in Step S215 (Step S215: YES), the control unit 60 takes the processing to Step S216.

As illustrated in FIG. 10, the control unit 60 determines whether or not one storage amount is equal to or smaller than the second set value in Step S216. In a case where one storage amount is larger than the second set value (Step S216: NO), the control unit 60 determines whether or not the other storage amount is equal to or larger than the first set value in Step S217. In a case where the other storage amount falls short of the first set value (Step S217: NO), the control unit 60 takes the processing to Step S216.

In a case where the other storage amount is equal to or larger than the first set value in Step S217 (Step S217: YES), the control unit 60 stops depressurizing the inside of the other intermediate storage 120 in Step S218.

In Step S219, the control unit 60 determines whether or not one storage amount is equal to or smaller than the second set value. In a case where one storage amount is larger than the second set value (Step S219: NO), the control unit 60 stands by until one storage amount becomes equal to or smaller than the second set value. When one storage amount is equal to or smaller than the second set value (Step S219: YES), the control unit 60 depressurizes the inside of one intermediate storage 120 and pressurizes the inside of the other intermediate storage 120 in Step S220. At this time, the control unit 60 depressurizes the inside of one intermediate storage 120 at the first pressure.

In a case one storage amount is equal to or smaller than the second set value in Step S216 (Step S216: YES), the control unit 60 stops depressurizing the inside of the other intermediate storage 120 in Step S221. In Step S222, the control unit 60 acquires the other storage amount. In Step S223, the control unit 60 depressurizes the inside of one intermediate storage 120 and pressurizes the inside of the other intermediate storage 120. At this time, the control unit 60 depressurizes the inside of one intermediate storage 120 at the third pressure.

In Step S224, the control unit 60 calculates a target supply amount to be supplied to one intermediate storage 120. A target supply amount is a difference between the first set value and the second set value in one intermediate storage 120.

In Step S225, the control unit 60 calculates supply time for which liquid can be supplied from the liquid supply source 101 to one intermediate storage 120. Supply time is time from the start of depressurization of the inside of the other intermediate storage 120 until the other storage amount becomes equal to or smaller than the second set value. The control unit 60 calculates supply time by dividing the other storage amount acquired in Step S222 by the outflow rate of liquid flowing out from the other intermediate storage 120.

In Step S226, the control unit 60 calculates the target inflow rate of liquid flowing from the liquid supply source 101 into one intermediate storage 120. Specifically, the control unit 60 calculates the target inflow rate by dividing the target supply amount calculated in Step S224 by the supply time calculated in Step S225.

In Step S227, the control unit 60 determines whether or not inflow rate detected by the first flow rate sensor 166 or the second flow rate sensor 168 falls short of the target inflow rate. In a case where the inflow rate falls short of the target inflow rate (Step S227: YES), the control unit 60 makes the degree of depressurization at which the inside of one intermediate storage 120 is depressurized larger in Step S228.

In Step S229, the control unit 60 determines whether or not the degree of depressurization is a maximum value (for example, −35 kPa). In a case where the degree of depressurization is not a maximum value (Step S229: NO), the control unit 60 takes the processing to Step S227.

In a case where the inflow rate is equal to or higher than the target inflow rate in Step S227 (Step S227: NO), the control unit 60 takes the processing to Step S202. In Step S229, in a case where the degree of depressurization is a maximum value (Step S229: YES), the control unit 60 takes the processing to Step S202.

Next, the operation of the liquid supplying device 100 (liquid ejecting apparatus 10) of the embodiment will be described.

The control unit 60 controls the pressure regulating mechanism 140 such that the degree of depressurization of the inside of the other intermediate storage 120 in the second supply control is variable, and the degree of depressurization becomes larger as the storage amount inside one intermediate storage 120 becomes smaller. That is, as one storage amount becomes smaller when pressurizing the inside of one intermediate storage 120, supply time becomes shorter and target inflow rate becomes higher. For this reason, the control unit 60 makes the degree of depressurization at which the inside of the other intermediate storage 120 is depressurized larger in accordance with target inflow rate.

According to the third embodiment, the following effects can be obtained in addition to the effects of the first embodiment and the second embodiment.

(3-1) The degree of depressurization of the inside of the other intermediate storage 120, which is performed after the storage amount inside the other intermediate storage 120 becomes the second set value while the inside of one intermediate storage 120 is being depressurized, becomes larger as the storage amount inside one intermediate storage 120 becomes smaller. Therefore, liquid can be continuously supplied from the intermediate storage 120 to the liquid ejecting unit 41 while maintaining the durability of the intermediate storage 120.

The embodiments may be modified as described in the followings. The embodiments and a modification example below may be combined at user's discretion.

In a case where liquid is not consumed (printing or a maintenance operation, which is discharging liquid, is not performed), the control unit 60 may not pressurize the inside of the other intermediate storage 120 when the inside of one intermediate storage 120, out of the first intermediate storage 121 and the second intermediate storage 122, is depressurized and liquid is supplied from the liquid supply source 101 to one intermediate storage 120.

In a case where liquid is not consumed (printing or a maintenance operation, which is discharging liquid, is not performed), and in a case where storage amounts of the first intermediate storage 121 and the second intermediate storage 122 are smaller than the first set value, the control unit 60 depressurizes the insides of both of the intermediate storages 120 to supply liquid from the liquid supply source 101 to both of the intermediate storages 120.

The accommodation amount acquisition unit 502 may acquire the amount of liquid accommodated in the liquid supply source 101 by means of calculation. In this case, the accommodation amount acquisition unit 502 may be included in the control unit 60. For example, the liquid supply source 101 has a memory unit that stores an accommodation amount. The accommodation amount acquisition unit 502 may acquire the volume of liquid supplied from the liquid supply source 101 to the intermediate storage 120 based on detection results from the flow rate sensors 166 and 168, and acquire an accommodation amount by subtracting the volume of the supplied liquid from the accommodation amount stored in the memory unit.

In the third embodiment, the control unit 60 may make a degree of depressurization larger in a case where the liquid supply source 101 is replaced.

In the third embodiment, the control unit 60 may change a degree of depressurization into a plurality of stages. For example, when a degree of depressurization is changed into two stages, the control unit 60 may make a degree of depressurization at which the inside of the other intermediate storage 120 is depressurized larger in a case where one storage amount is smaller than an average value of the first set value and the second set value, compared to a case where one storage amount is larger than the average value. In other words, in a case where one storage amount is near the second set value, the control unit 60 may make a degree of depressurization at which the inside of the other intermediate storage 120 is depressurized larger compared to a case where one storage amount is near the first set value.

Out of the first intermediate storage 121 and the second intermediate storage 122, a storage with a larger storage amount may be set as one intermediate storage 120, and a storage with a smaller storage amount may be set as the other intermediate storage 120. Out of the first intermediate storage 121 and the second intermediate storage 122, the intermediate storage 120 that is first depressurized may be set as one intermediate storage 120 regardless of a storage amount. For example, the first intermediate storage 121 may be set as one intermediate storage 120, and the second intermediate storage 122 may be set as the other intermediate storage 120.

The first set value and the second set value may be set for each of the first intermediate storage 121 and the second intermediate storage 122. The first intermediate storage 121 and the second intermediate storage 122 may have different storage amounts.

The inflow rate of liquid flowing from the liquid supply source 101 into the intermediate storage 120 is proportional to a degree of depressurization at which the inside of the intermediate storage 120 is depressurized. That is, as a degree of depressurization becomes larger, the inflow rate increases. For this reason, the control unit 60 may store a relationship between a degree of depressurization and inflow rate in the form of a table, and depressurize the inside of the intermediate storage 120 at a magnitude corresponding to target inflow rate.

Inflow rate may be calculated by dividing a hydraulic head difference between the intermediate storage 120 and the liquid supply source 101 and a pressure difference calculated from a degree of depressurization at which the inside of the intermediate storage 120 is depressurized by flow path resistance from the liquid supply source 101 to the intermediate storage 120. Since flow path resistance is proportional to the viscosity of liquid, flow path resistance becomes lower as temperate becomes higher. For this reason, it is preferable that the liquid ejecting apparatus 10 include a thermometer and calculate inflow rate by taking flow path resistance which changes with temperature into consideration.

The control unit 60 may not change the degree of depressurization of the inside of the intermediate storage 120 even in a case where the liquid supply source 101 is replaced.

Even in a case where the amount of liquid accommodated in the liquid supply source 101 falls short of the first set value, the control unit 60 may perform the second supply control. That is, the control unit 60 may make a degree at which the inside of the intermediate storage 120 is depressurized larger even in a case where the accommodation amount falls short of the first set value. Even in a case where the other storage amount becomes the second set value while depressurizing one intermediate storage 120 and the accommodation amount falls short of the first set value, the control unit 60 may stop depressurizing one intermediate storage 120 and supply liquid from one intermediate storage 120 to the liquid ejecting unit 41.

The degree of depressurization of the inside of the other intermediate storage 120 after the other storage amount has become the second set value while the inside of one intermediate storage 120 is being depressurized may be equivalent to a degree of depressurization at which the inside of one intermediate storage 120 is depressurized. That is, the control unit 60 may depressurize the inside of the other intermediate storage 120 at the first pressure in a case where the other storage amount becomes the second set value while depressurizing the inside of one intermediate storage 120 at the first pressure.

The degree of depressurization of the inside of the other intermediate storage 120 after the other storage amount becomes the second set value while the inside of one intermediate storage 120 is being depressurized and the degree of depressurization after the liquid supply source 101 is replaced may be different from each other.

Figure 11:
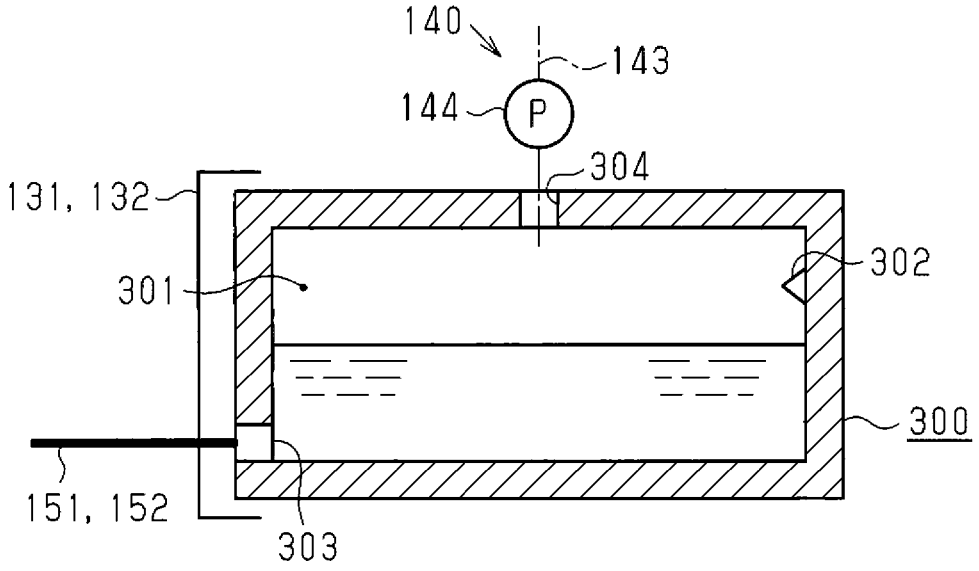
FIG. 11 is a schematic diagram illustrating a modification example of an intermediate storage included in the liquid supplying device.

The intermediate storage 120 may be an open system intermediate storage 300 illustrated in FIG. 11. That is, as illustrated in FIG. 11, the intermediate storage 300 includes a liquid accommodation chamber 301 that accommodates liquid, a liquid surface sensor 302 that detects the volume of liquid accommodated in the liquid accommodation chamber 301, and the pressure regulating mechanism 140 that regulates the pressure of the liquid accommodation chamber 301. A liquid connection port 303, to which the upstream end of the first liquid flow path 151 is connected, and a pressure regulating port 304, to which the pressure regulating mechanism 140 is connected, are provided in the liquid accommodation chamber 301. The liquid connection port 303 is provided at a vertically lower side of the liquid accommodation chamber 301, and the pressure regulating port 304 is provided at a vertically upper side of the liquid accommodation chamber 301.

It is preferable that the liquid accommodation chamber 301 be a closed space except for the liquid connection port 303 and the pressure regulating port 304. That is, the first liquid flow path 151 or the second liquid flow path 152 is connected to the liquid connection port 303 without a gap, and the pressure regulating flow path 143 is connected to the pressure regulating port 304 without a gap.

The liquid surface sensor 302 is a configuration for detecting the level of liquid surface inside the liquid accommodation chamber 301. For example, the liquid surface sensor 302 may have a configuration of telling the control unit 60 that the level of liquid surface has reached an upper limit value for the level of liquid surface set in the liquid accommodation chamber 301.

While the pressure regulating mechanism 140 causes liquid to flow out from the liquid accommodation chamber 301 via the first liquid flow path 151 or the second liquid flow path 152 by pressurizing the inside of the liquid accommodation chamber 301, the pressure regulating mechanism 140 causes liquid to flow into the liquid accommodation chamber 301 via the first liquid flow path 151 or the second liquid flow path 152 by depressurizing the inside of the liquid accommodation chamber 301.

In a case where liquid is supplied from the liquid supply source 101 to the liquid accommodation chamber 301, a liquid surface inside the liquid accommodation chamber 301 rises according to the supply amount of liquid. In this regard, according to this configuration, the driving of the pressure regulating mechanism 140 can be stopped in a case where a liquid surface inside the liquid accommodation chamber 301 has reached the upper limit value, since the liquid surface sensor 302 is included. Therefore, liquid can be prevented from being discharged to the outside of the liquid supply source 101 by the pressure regulating mechanism 140 sucking the liquid.

In the open system intermediate storage 300, as a degree at which the inside of the liquid accommodation chamber 301 is depressurized becomes larger, bubbles are more likely to be generated. For this reason, the generation of bubbles due to depressurization can be reduced by making the degree of depressurization larger only in a case where liquid is supplied from the intermediate storage 300 to the liquid ejecting unit 41.

In the intermediate storage 300 illustrated in FIG. 11, the liquid surface sensor 302 may be a liquid volume sensor that detects the volume of liquid inside the liquid accommodation chamber 301.

The intermediate storages 120 may be detachably disposed on the carriage 43. In this configuration, liquid stored in the intermediate storages 120 may be stirred by the carriage 43 reciprocating in the width direction.

The intermediate storages 120 may be provided vertically above the liquid ejecting unit 41. In this case, liquid may be supplied from the intermediate storage 120 to the liquid ejecting unit 41 by means of a hydraulic head difference. According to this, the pressure regulating mechanism 140 may not be driven when supplying liquid from the intermediate storage 120 to the liquid ejecting unit 41.

The liquid supply source 101 (liquid supply source holding unit 102) may be provided vertically above the intermediate storages 120 (first intermediate storage holding unit 131 and second intermediate storage holding unit 132). According to this, a burden on the pressure regulating mechanism 140 when liquid is supplied from the liquid supply source 101 to the intermediate storage 120 can be alleviated by the amount of hydraulic head difference.

In addition, in this case, the liquid supply source 101 may be a pack accommodating liquid and be disposed vertically above the intermediate storages 120 so as to be in a state of hanging down. Furthermore, in this case, the liquid supply source holding unit 102 is an adaptor that connects the pack-like liquid supply source 101 and the replenishment flow path 156.

In a case where a source for supplying liquid to the liquid ejecting unit 41 is switched from one intermediate storage 120 to the other intermediate storage 120, the supply of liquid from the other intermediate storage 120 to the liquid ejecting unit 41 may be started after the supply of liquid from liquid supply source 101 to one intermediate storage 120 has started.

The liquid pressure regulating mechanism 250 may include at least the pressure chamber 253. According to this, in a case where fluctuations in the pressure of liquid occurs on the upstream side of the liquid pressure regulating mechanism 250, the fluctuations in the pressure can be prevented from affecting the downstream side of the liquid pressure regulating mechanism 250 by changing the volume of the pressure chamber 253.

In a case where the liquid pressure regulating mechanism 250 includes only the pressure chamber 253, the pressure chamber 253 may be configured such that all wall portions are elastic walls having elasticity.

The filter unit 210, the liquid storing unit 230, and the liquid pressure regulating mechanism 250 may not be provided. Even in this case, the effect (1) of the embodiment can be obtained.

The deaerating chamber 241 of the deaerating mechanism 240 may be provided on the supply flow path 155 that connects the pressure chamber 253 of the liquid pressure regulating mechanism 250 and the filter 416 of the liquid ejecting unit 41. In addition, the deaerating chamber 241 of the deaerating mechanism 240 may be provided in a region of the supply flow path 155, which is not positioned on the carriage 43.

The first intermediate storage holding unit 131 and the second intermediate storage holding unit 132 may undetachably hold the intermediate storages 120. In this case, the first open/closed valve 165 and the second open/closed valve 167 may not be provided.

Liquid ejected by the liquid ejecting unit 41 is not limited to an ink. For example, the liquid may be a liquefied material formed by particles of functional materials being dispersed over or mixed with liquid. For example, a configuration where recording is performed by ejecting a liquefied material which includes materials such as electrode materials and color materials (pixel materials) used in manufacturing a liquid crystal display, an electroluminescent (EL) display, and a surface light-emitting display in the form of dispersion or dissolution may be adopted.

The medium M is not limited to paper, may be a plastic film or a thin plate, or may be cloth used in a textile printing apparatus. In addition, the medium M may be a single slip cut into a predetermined size. For example, the medium M may be a rolled medium M wound in a cylindrical shape, may be any shape of clothing such as a T-shirt, or may be any shape of object such as tableware and stationery.

The entire disclosure of Japanese Patent Application No. 2016-168231, filed Aug. 30, 2016 and No. 2017-100658, filed May 22, 2017 are expressly incorporated by reference herein.

What is claimed is:

1. A liquid supplying device comprising:

a first liquid flow path that can supply liquid to a liquid ejecting unit which ejects the liquid;

a first intermediate storage that is provided on the first liquid flow path and stores the liquid;

a second liquid flow path that can supply the liquid to the liquid ejecting unit without going through the first intermediate storage;

a second intermediate storage that is provided on the second liquid flow path and stores the liquid;

a liquid supply source holding unit that holds a liquid supply source accommodating the liquid and is connected to the first intermediate storage and the second intermediate storage such that the liquid accommodated in the liquid supply source can be supplied to the first intermediate storage and the second intermediate storage;

a pressure regulating mechanism that can regulate pressures inside the first intermediate storage and inside the second intermediate storage;

a control unit that controls the pressure regulating mechanism such that the inside of one intermediate storage, out of the first intermediate storage and the second intermediate storage, is depressurized and the liquid is supplied from the liquid supply source to the one intermediate storage;

a common liquid flow path that is connected to an end portion of the first liquid flow path on a liquid ejecting unit side and an end portion of the second liquid flow path on the liquid ejecting unit side such that the liquid can be supplied from the first intermediate storage and the second intermediate storage to the liquid ejecting unit; and a liquid pressure regulating mechanism that is provided on the common liquid flow path and has a pressure chamber, which is a pressure chamber that can store the liquid and of which at least a part is formed of a flexible wall that can be deformed by a change in a pressure inside the pressure chamber.

2. The liquid supplying device according to claim 1, further comprising:

a first check valve that is provided on the first liquid flow path, allows the flow of the liquid to the liquid ejecting unit, and restricts the flow of the liquid to the first intermediate storage;

a second check valve that is provided on the second liquid flow path, allows the flow of the liquid to the liquid ejecting unit, and restricts the flow of the liquid to the second intermediate storage;

a third liquid flow path that is connected at a position between the first intermediate storage on the first liquid flow path and the first check valve such that the liquid accommodated in the liquid supply source can be supplied to the first intermediate storage;

a third check valve that is provided on the third liquid flow path, allows the flow of the liquid to the first intermediate storage, and restricts the flow of the liquid to the liquid supply source;

a fourth liquid flow path that is connected at a position between the second intermediate storage on the second liquid flow path and the second check valve such that the liquid accommodated in the liquid supply source can be supplied to the second intermediate storage; and a fourth check valve that is provided on the fourth liquid flow path, allows the flow of the liquid to the second intermediate storage, and restricts the flow of the liquid to the liquid supply source.

3. The liquid supplying device according to claim 1, further comprising:

a first open/closed valve that can be switched between an open state where the flow of the liquid inside the first liquid flow path is allowed and a closed state where the flow of the liquid inside the first liquid flow path is blocked; and a second open/closed valve that can be switched between an open state where the flow of the liquid inside the second liquid flow path is allowed and a closed state where the flow of the liquid inside the second liquid flow path is blocked, wherein the first intermediate storage is provided such that the first intermediate storage can be separated from the first liquid flow path, and the second intermediate storage is provided such that the second intermediate storage can be separated from the second liquid flow path.

4. The liquid supplying device according to claim 1, wherein the first intermediate storage and the second intermediate storage each have a liquid accommodation unit that is formed of a bag-like flexible member which can accommodate the liquid and a case in which an accommodation space accommodating the liquid accommodation unit is formed, a liquid connection port connected to a corresponding liquid flow path, out of the first liquid flow path and the second liquid flow path, is provided in the liquid accommodation unit, a pressure regulating port that can communicate with the accommodation space and the pressure regulating mechanism are provided in the case, and the pressure regulating mechanism regulates the pressure of the accommodation space.

5. The liquid supplying device according to claim 1, further comprising:

a filter unit that is provided on an upstream side of the liquid pressure regulating mechanism on the common liquid flow path and has a filter, which collects foreign substances in the liquid, and a filter chamber, which accommodates the filter.

6. The liquid supplying device according to claim 1, wherein the control unit controls the pressure regulating mechanism such that the inside of one intermediate storage, out of the first intermediate storage and the second intermediate storage, is depressurized and the inside of the other intermediate storage is pressurized.

7. The liquid supplying device according to claim 6, further comprising:

a pressurizing chamber that is provided on an upstream side of the liquid pressure regulating mechanism on the common liquid flow path, is a pressurizing chamber which can store the liquid, and pressurizes the liquid stored in the pressurizing chamber at a pressure lower than a pressure at which the intermediate storage is pressurized.

8. The liquid supplying device according to claim 1, wherein the control unit performs first supply control of controlling the pressure regulating mechanism such that the depressurization of the inside of the one intermediate storage is stopped in a case where a storage amount inside the one intermediate storage is a first set value, the inside of the other intermediate storage is depressurized in a case where a storage amount inside the other intermediate storage is a second set value that is smaller than the first set value, and the liquid is supplied from the one intermediate storage to the liquid ejecting unit, and performs second supply control of controlling the pressure regulating mechanism such that the depressurization of the inside of the one intermediate storage is stopped in a case where a storage amount inside the other intermediate storage is the second set value while the inside of the one intermediate storage is being depressurized, and the liquid is supplied from the one intermediate storage to the liquid ejecting unit.

9. The liquid supplying device according to claim 8, wherein the control unit controls the pressure regulating mechanism such that the inside of the other intermediate storage is depressurized in a case where the storage amount inside the other intermediate storage is the second set value, in the second supply control, and a degree of depressurization inside the other intermediate storage in the second supply control is larger than a degree of depressurization inside the other intermediate storage in the first supply control.

10. The liquid supplying device according to claim 9, wherein the degree of depressurization inside the other intermediate storage in the second supply control is variable, and the control unit controls the pressure regulating mechanism such that the degree of depressurization becomes larger as the storage amount inside the one intermediate storage becomes smaller.

11. The liquid supplying device according to claim 8, wherein the control unit performs the second supply control in a case where the amount of the liquid accommodated in the liquid supply source is equal to or larger than the first set value.

12. The liquid supplying device according to claim 8, wherein the control unit controls the pressure regulating mechanism such that the degree of depressurization inside the intermediate storage is larger than the degree of depressurization before the liquid supply source is replaced in a case where the liquid supply source held by the liquid supply source holding unit is replaced with another liquid supply source.

13. A liquid ejecting apparatus comprising:

a liquid ejecting unit that ejects liquid;

a first liquid flow path that can supply the liquid to the liquid ejecting unit;

a first intermediate storage that is provided on the first liquid flow path and stores the liquid;

a second liquid flow path that can supply the liquid to the liquid ejecting unit without going through the first intermediate storage;

a second intermediate storage that is provided on the second liquid flow path and stores the liquid;

a liquid supply source holding unit that holds a liquid supply source accommodating the liquid and is connected to the first intermediate storage and the second intermediate storage such that the liquid accommodated in the liquid supply source can be supplied to the first intermediate storage and the second intermediate storage;

a common liquid flow path that is connected to an end portion of the first liquid flow path on a liquid ejecting unit side and an end portion of the second liquid flow path on the liquid ejecting unit side such that the liquid can be supplied from the first intermediate storage and the second intermediate storage to the liquid ejecting unit;

a liquid pressure regulating mechanism that is provided on the common liquid flow path and has a pressure chamber, which is a pressure chamber that can store the liquid and of which at least a part is formed of a flexible wall that can be deformed by a change in a pressure inside the pressure chamber;

a pressure regulating mechanism that can regulate pressures inside the first intermediate storage and inside the second intermediate storage; and a control unit that controls the pressure regulating mechanism such that the inside of one intermediate storage, out of the first intermediate storage and the second intermediate storage, is depressurized and the liquid is supplied from the liquid supply source to the one intermediate storage.

14. The liquid ejecting apparatus according to claim 13, wherein the control unit performs first supply control of controlling the pressure regulating mechanism such that the depressurization of the inside of the one intermediate storage is stopped in a case where a storage amount inside the one intermediate storage is a first set value, the inside of the other intermediate storage is depressurized in a case where a storage amount inside the other intermediate storage is a second set value that is smaller than the first set value, and the liquid is supplied from the one intermediate storage to the liquid ejecting unit, and performs second supply control of controlling the pressure regulating mechanism such that the depressurization of the inside of the one intermediate storage is stopped in a case where a storage amount inside the other intermediate storage is the second set value while the inside of the one intermediate storage is being depressurized, and the liquid is supplied from the one intermediate storage to the liquid ejecting unit.

15. A liquid supplying method of a liquid supplying device, the liquid supply device including a first liquid flow path that can supply liquid to a liquid ejecting unit which ejects the liquid, a first intermediate storage that is provided on the first liquid flow path and stores the liquid, a second liquid flow path that can supply the liquid to the liquid ejecting unit without going through the first intermediate storage, and a second intermediate storage that is provided on the second liquid flow path and stores the liquid, and of alternately repeating an operation of supplying, which is automatically depressurizing the inside of one intermediate storage, out of the first intermediate storage and the second intermediate storage, and supplying the liquid from the liquid supply source accommodating the liquid to the one intermediate storage while supplying the liquid from the other intermediate storage to the liquid ejecting unit, with respect to the first intermediate storage and the second intermediate storage, a common liquid flow path that is connected to an end portion of the first liquid flow path on a liquid ejecting unit side and an end portion of the second liquid flow path on the liquid ejecting unit side such that the liquid can be supplied from the first intermediate storage and the second intermediate storage to the liquid ejecting unit, and a liquid pressure regulating mechanism that is provided on the common liquid flow path and has a pressure chamber, which is a pressure chamber that can store the liquid and of which at least a part is formed of a flexible wall that can be deformed by a change in a pressure inside the pressure chamber, the method comprising:

supplying the liquid from the one intermediate storage to the liquid ejecting unit by stopping the depressurization of the inside of the one intermediate storage in a case where a storage amount inside the one intermediate storage is a first set value and by depressurizing the inside of the other intermediate storage in a case where a storage amount inside the other intermediate storage is a second set value that is smaller than the first set value; and automatically supplying the liquid from the one intermediate storage to the liquid ejecting unit by stopping the depressurization of the inside of the one intermediate storage in a case where a storage amount inside the other intermediate storage is the second set value while the inside of the one intermediate storage is being depressurized.

* * * * *